US007698860B2

(12) United States Patent
Hockemeyer et al.

(10) Patent No.: US 7,698,860 B2
(45) Date of Patent: Apr. 20, 2010

(54) RAISED DECK SYSTEM FOR EMERGENCY ISOLATION AND TREATMENT SHELTER (EITS)

(75) Inventors: Timothy J. Hockemeyer, Midland, MI (US); O. David Rogers, Sanford, MI (US)

(73) Assignee: Stageright Corporation, Clare, MI (US)

( * ) Notice: Subject to any disclaimer, the term of this patent is extended or adjusted under 35 U.S.C. 154(b) by 536 days.

(21) Appl. No.: 11/514,300

(22) Filed: Aug. 31, 2006

(65) Prior Publication Data

US 2008/0053018 A1 Mar. 6, 2008

(51) Int. Cl.
*E04B 5/43* (2006.01)

(52) U.S. Cl. ..... 52/263; 52/650.3; 182/179.1; 182/186.7

(58) Field of Classification Search ..... 52/263, 52/650.3; 473/62; 108/51.11; 182/179.1, 182/186, 186.7
See application file for complete search history.

(56) References Cited

U.S. PATENT DOCUMENTS 1,571,129 A * 1/1926 Luckhoff ..... 108/33
2,785,735 A * 3/1957 Banks ..... 108/128
4,125,979 A 11/1978 McLaughlin
4,273,463 A * 6/1981 Dobersch ..... 403/246
4,290,246 A 9/1981 Hilsey
4,445,307 A * 5/1984 Puccinelli et al. ..... 52/638
4,630,417 A * 12/1986 Collier ..... 52/263
4,731,964 A 3/1988 Phillips
4,858,398 A 8/1989 Ricchini
4,872,470 A 10/1989 Hayashida et al.
5,060,426 A * 10/1991 Jantzen ..... 52/86
5,072,554 A 12/1991 Hayman
5,078,532 A * 1/1992 Williams ..... 403/246
5,083,410 A 1/1992 Watson
5,113,631 A 5/1992 diGirolamo et al.
5,195,293 A 3/1993 diGirolamo et al.
5,402,612 A 4/1995 diGirolamo et al.
5,474,501 A * 12/1995 Teng ..... 472/62
5,477,649 A * 12/1995 Bessert ..... 52/263
5,515,659 A 5/1996 MacDonald et al.
5,584,158 A * 12/1996 Johnson ..... 52/832
5,706,624 A 1/1998 Lipson
5,921,047 A 7/1999 Walker
5,930,961 A 8/1999 Beaudet
6,173,547 B1 1/2001 Lipson
6,260,312 B1 7/2001 Spene et al.
6,263,637 B1 7/2001 Spene et al.
6,266,863 B1 7/2001 Spene et al.
6,471,000 B2 * 10/2002 Wolfe ..... 182/8
6,536,147 B1 3/2003 Funk et al.
6,557,955 B2 5/2003 Saravis (Continued)

*Primary Examiner*—Richard E Chilcot, Jr.
*Assistant Examiner*—Alp Akbasli
(74) *Attorney, Agent, or Firm*—Carlson, Gaskey & Olds PC

(57) ABSTRACT

An Emergency Isolation and Treatment Shelter (EITS) deck system is constructed from a multiple of deck unit modules. Each deck unit module includes four adjustable leg assemblies attachable together by a lower truss between each leg assembly so as to support a deck surface panel. The size of the deck unit module defines the modularity of the EITS. Each leg assembly includes a primary leg, an intermediate leg, and a screw foot each in telescopic relationship. Each leg assembly may be telescoped independently to provide a level deck surface irrespective of the underlying terrain.

18 Claims, 26 Drawing Sheets

U.S. PATENT DOCUMENTS 6,585,083 B2 * 7/2003 Santarlasci ..... 182/118
6,598,363 B1 7/2003 Ferguson et al.
6,637,165 B2 * 10/2003 Jette ..... 52/220.1
6,694,685 B2 2/2004 Celata
6,854,218 B2 2/2005 Weiss
6,951,079 B2 10/2005 Weiss
6,981,347 B1 1/2006 Walburger
7,048,346 B2 5/2006 Saravis
2002/0092707 A1 * 7/2002 Schwoerer ..... 182/179.1
2008/0053003 A1 * 3/2008 Hockemeyer et al. ..... 52/22
2008/0053017 A1 * 3/2008 Hockemeyer et al. ..... 52/263
2008/0053018 A1 * 3/2008 Hockemeyer et al. ..... 52/263
2008/0053032 A1 * 3/2008 Hockemeyer et al. .... 52/651.07

* cited by examiner

RAISED DECK SYSTEM FOR EMERGENCY ISOLATION AND TREATMENT SHELTER (EITS)

BACKGROUND OF THE INVENTION

The present invention relates to a temporary emergency shelter, and more particularly to a raised deck system therefor which accommodates uneven terrain.

Most structures are built from traditional materials and features which are inappropriate for non-traditional construction applications speed of assembly is essential. One situation where common methods and materials are particularly inappropriate is emergency/natural disaster situations or military operations in remote locations. In such situations, it is required that the materials used to construct a temporary building be light weight such that they are readily transported. Other requirements include low cost, ease of assembly, and minimization of the tools required for assembly.

Various prefabricated, temporary and modular building systems currently exist. Each has various tradeoffs including transportability, construction time and resistance to the elements. Typically, the more permanent the structure the less transportable the structure becomes and the greater the terrain preparation is required upon which the temporary structure is to be built.

One complicating factor regarding the construction of a temporary structure is that the terrain where the structure is to be located may not be suitable for construction of conventional prefabricated structures. Oftentimes, the site where the structure is to be located includes undesirable terrain features such as undulated terrain and other undesirable environmental conditions such as sandy, muddy or flooded terrain which complications construction of relatively rigid and permanent temporary structures. Such complications are particularly acute for emergency hospital-type structures which require sterile locations and may need to be capable of overpressure to sustain operation in nuclear biological and chemical (NBL) environments.

Accordingly, it is desirable to provide a modular, lightweight, easily-assembled, relatively rigid and permanent building structure and a method for assembly therefore which readily accommodates undesirable terrain features.

SUMMARY OF THE INVENTION

The Emergency Isolation and Treatment Shelter (EITS) deck system according to the present invention is constructed from a multiple of deck unit modules. Each deck unit module includes four adjustable leg assemblies attachable together by a lower truss between each leg assembly so as to support a deck surface panel. The deck unit modules may be attached together to form a deck system of any desired shape and size. The size of the deck unit module defines the modularity of the EITS. That is, each deck unit module is a building block by which the other components are referenced. It should be understood that the deck system may be utilized for various purposes other than as a component of the EITS.

Each leg assembly includes a primary leg, an intermediate leg, and a screw foot each in telescopic relationship. Each leg assembly may be telescoped independently to provide a level deck surface irrespective of the underlying terrain. Coarse height adjustment is provided between the primary leg and the intermediate leg through a pinned interface, while a finer height adjustment is provided by a threaded interface between the intermediate leg and the screw foot. The deck system may be assembled in various arrangements such that the intersection of up to four deck unit modules are attached together with a single leg assembly. That is, each leg assembly may connect up to four deck unit modules. Each deck unit module of the deck system is further connected to adjacent deck unit module(s) by a rigid wall system.

The present invention therefore provides a modular, lightweight, easily-assembled, relatively rigid and permanent building structure and a method for assembly therefore which readily accommodates undesirable terrain features.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1A:
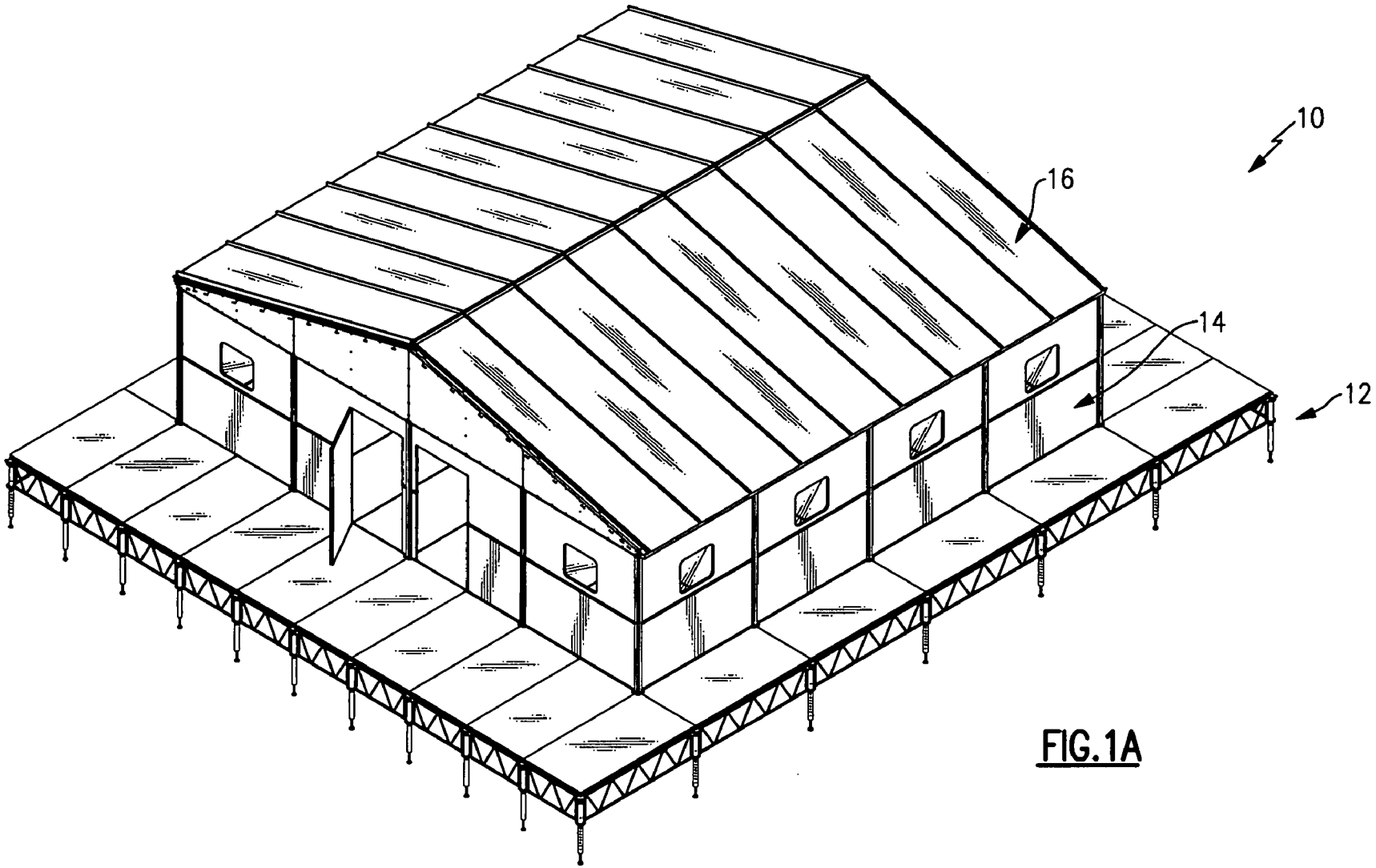
FIG. 1A is a perspective view of an exemplary EITS structure.

FIG. 1A illustrates a general perspective view of an Emergency Isolation and Treatment Shelter (EITS) 10. The EITS generally includes a deck system 12, a rigid wall system 14 and a roof system 16. The EITS 10 is a rigid-walled, modular, container transportable facility that is rapidly deployable in a variety of situations. The EITS 10 can be erected and fully functioning within days offering shelter, electrical services, heating/cooling, and bathroom facilities. Assembled quicker than pre-cast or stick built structures, the EITS 10 can be erected for short or long term usage upon a variety of undesirable terrain features. Although a simplified structure is disclosed in the illustrated embodiment, it should be understood that a multitude of various structures may be combined as modules to provide significant facilities (FIG. 1B) which may be utilized for various purposes.

Figure 2A:
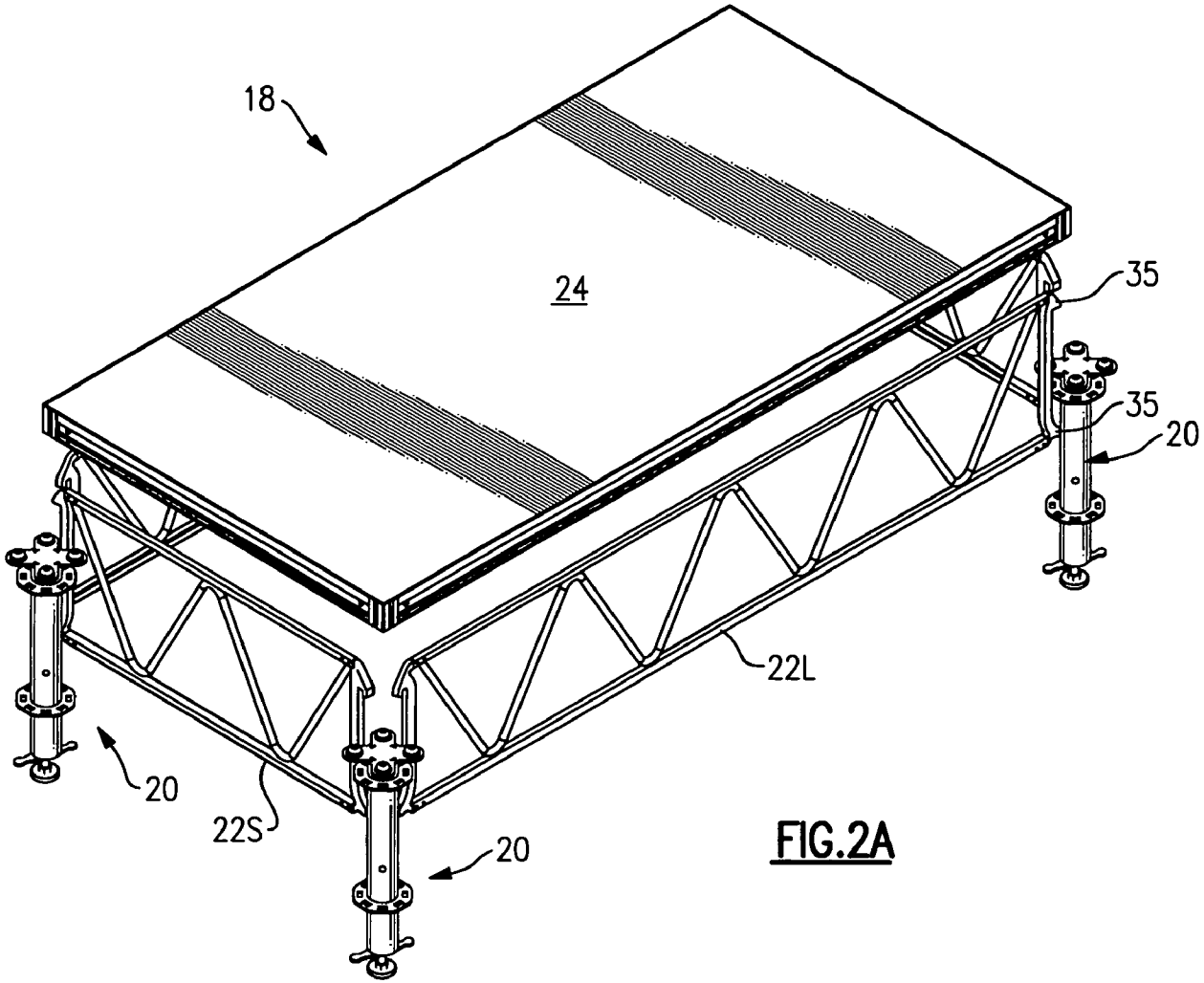
FIG. 2A is an exploded view of a deck unit module.

Referring to FIG. 2A, the deck system 12 is constructed from a multiple of deck unit modules 18. Each deck unit module 18 includes four adjustable leg assemblies 20 attachable together by a lower truss 22L, 22S between each leg assembly 20 so as to support a deck surface panel 24. The deck unit modules 18 may be attached together to form a deck system 12 of any desired shape and size. Preferably, each surface panel 24 is a rectilinear four feet by eight feet panel, but deck surface panels 24 of any size may be usable with the present invention. The deck surface panel 24 is preferably of a laminated sandwich construction to provide a rigid structure which is supported by the trusses 22L, 22S.

Preferably, the size of the deck unit module 18 defines the modularity of the EITS 10. That is, each deck unit module 18 is a building block by which the other components such as walls are related. It should be further understood that the deck system 12 may be utilized for various purposes other than as a component of the EITS 10 such as a stage or bridge system.

Figure 2E:
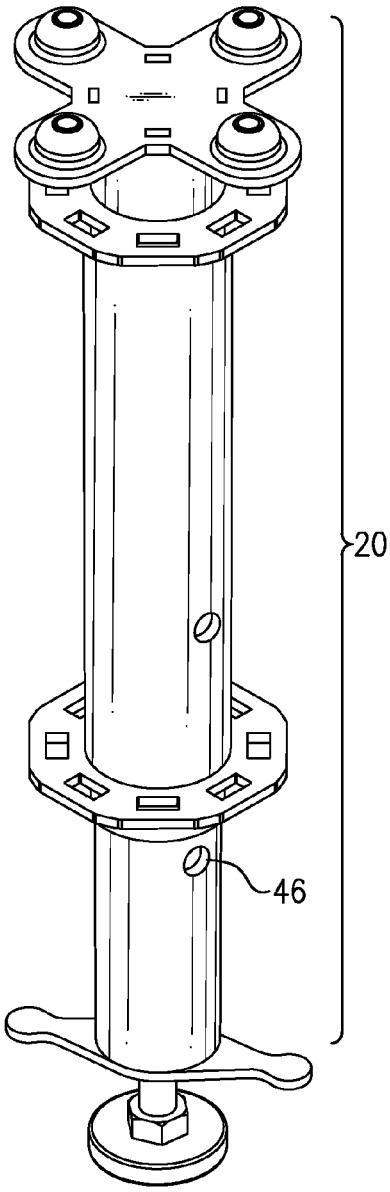
FIG. 2E is a perspective view of an adjustable leg assembly in a retracted position.
Figure 2B:
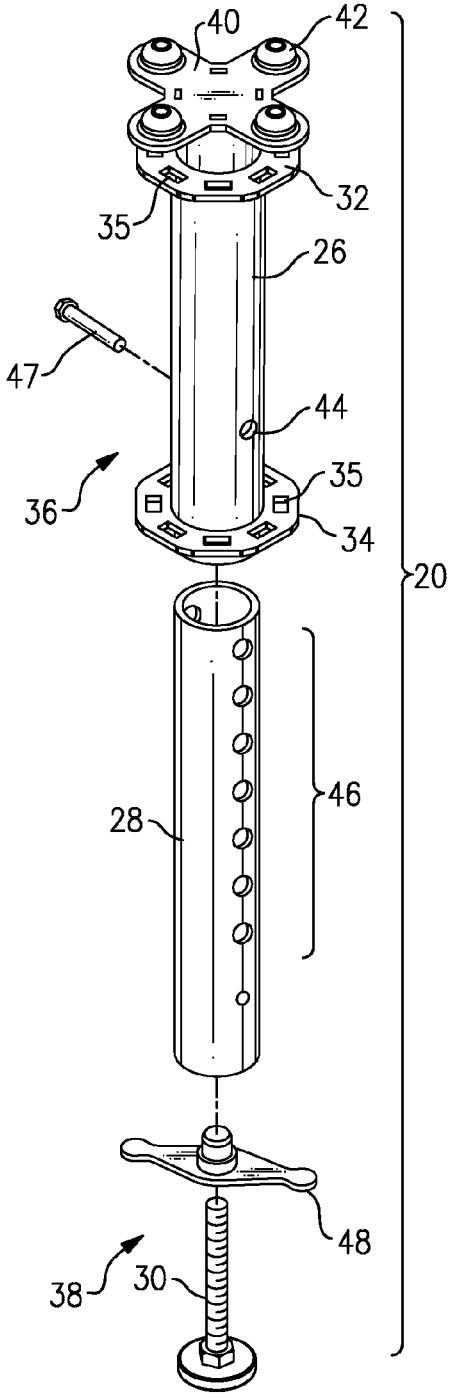
FIG. 2B is an exploded view of an adjustable leg assembly of the deck module unit.
Figure 2C:
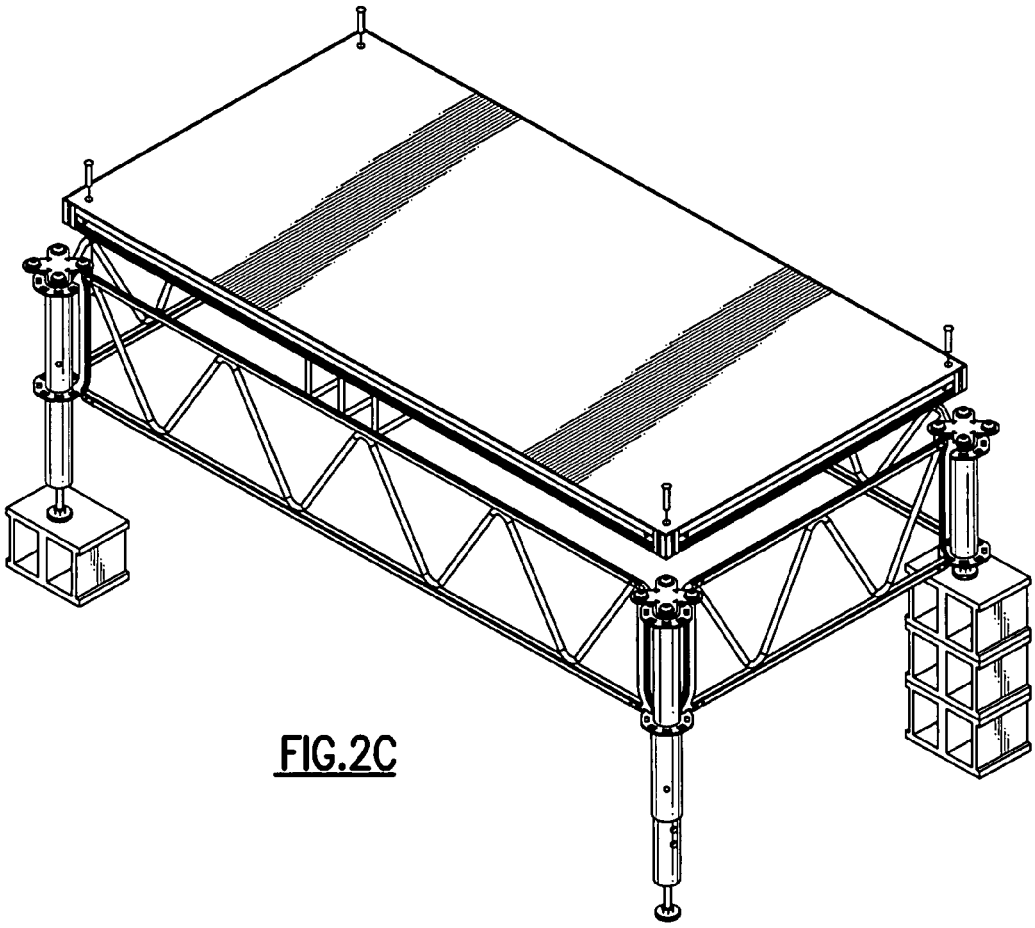
FIG. 2C is a perspective view of a deck unit module illustrating the accommodation of an uneven terrain surface.

Referring to FIG. 2B, each leg assembly 20 includes a primary leg 26, an intermediate leg 28 and a screw foot 30 each in telescopic relationship. Each leg assembly 20 may be telescoped independently to provide a level deck surface 24 irrespective of the underlying terrain (FIG. 2C).

Figure 2D:
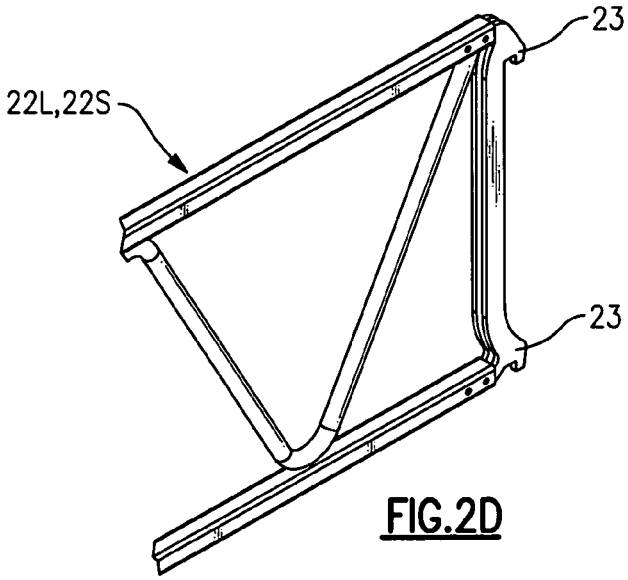
FIG. 2D is a perspective view of a lower truss of the deck unit module.

The primary leg 26 is of generally tubular construction with an upper truss attachment flange 32 and a lower truss attachment flange 34. The upper truss attachment flange 32 and the lower truss attachment flange 34 preferably each include eight truss attachment apertures 35 such that the lower truss 22L, 22S may be mounted at forty-five (45) degree increments about any leg assembly 20. Each lower truss 22L, 22S includes an upper and lower attachment hook 23 (FIGS. 2A and 2D) adjacent each corner thereof to selectively engage one of the truss attachment apertures 35 of the upper truss attachment flange 32 and the lower truss attachment flange 34.

Figure 3:
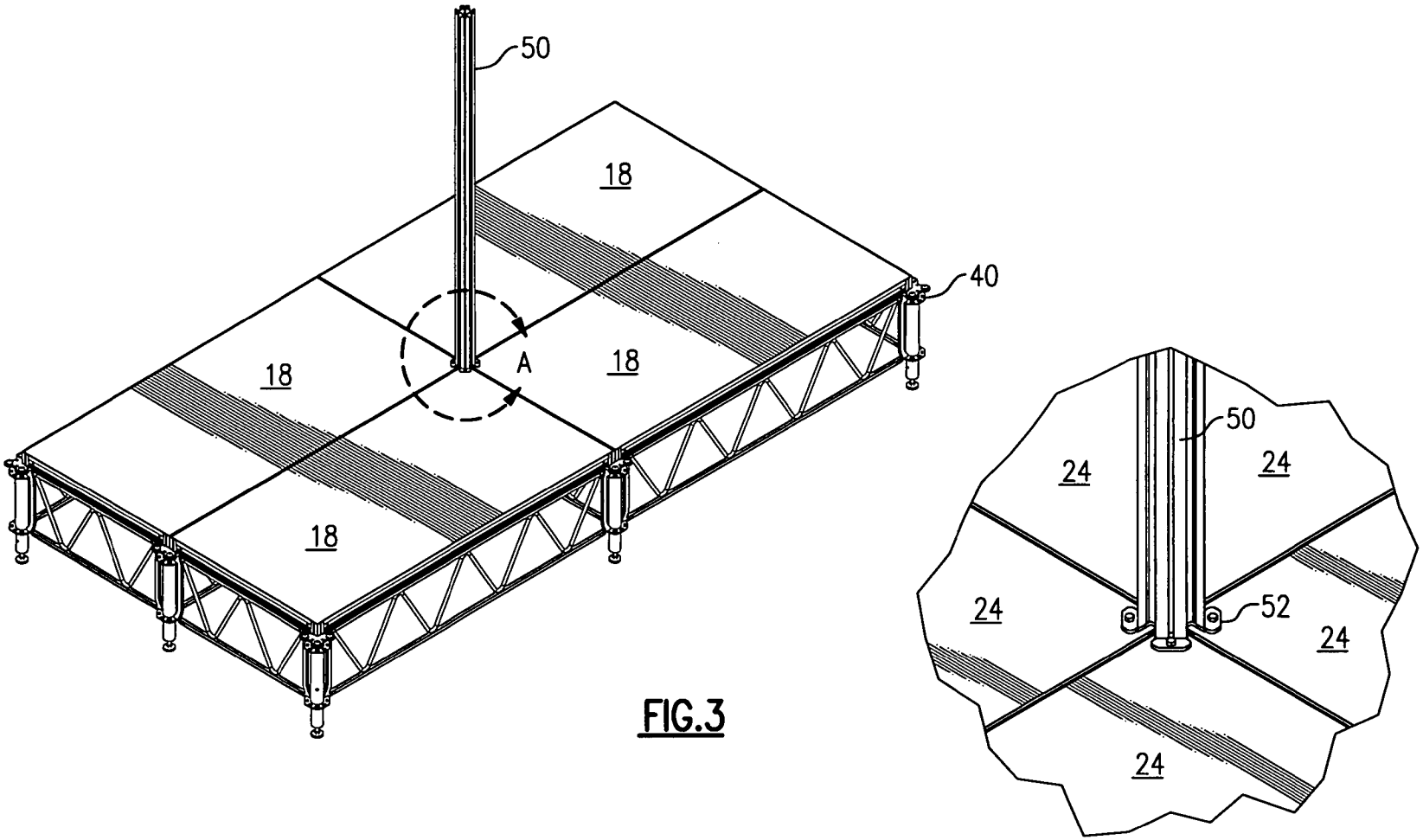
FIG. 3 is a perspective view of a support column mounted to a multiple of deck unit modules.

The uppermost end segment of the primary leg 26 includes a deck attachment plate 40. The deck attachment plate 40 preferably includes four deck attachment apertures 42 such that four deck surfaces 24 may interface upon a single deck attachment plate 40 with fasteners f (FIG. 3).

Coarse height adjustment is provided between the primary leg 26, and the intermediate leg 28 through a pinned interface 36, while a finer height adjustment is provided by a threaded interface 38 between the intermediate leg 28 and the screw foot 30. The primary leg 26 includes a primary pin aperture 44 while the intermediate leg 28 includes a multiple of intermediate pin apertures 46. Preferably, the intermediate pin apertures are elongated to facilitate adjustment and assembly (best seen in FIG. 2E). A pin 47 is received through the primary pin aperture 44 to engage one of multiple of intermediate pin apertures 46 to provide the coarse adjustment. The threaded interface 38 between the intermediate leg 28 and the screw foot 30 is preferably an ACME thread in which a wing nut 48 is selectively rotated to adjust the length of the screw foot 30 relative the intermediate leg 28.

The deck system 12 may be assembled in various arrangements such that the intersection of up to four deck unit modules 18 are attached together with each leg assembly 20. That is, each leg assembly 20 may connect up to four deck unit modules 18—one for each deck attachment aperture 42.

Figure 4A:
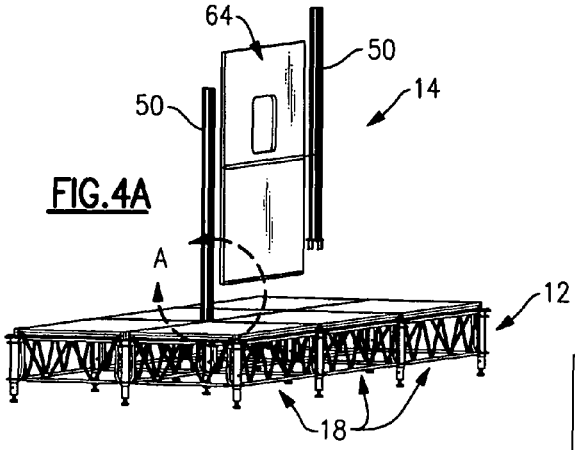
FIG. 4A is an exploded view of a rigid wall assembly relative to the deck system.

Referring to FIG. 4A, each deck unit module 18 of the deck system 12 is further connected to adjacent deck unit module (s) 18 by the rigid wall system 14. The rigid wall system 14 is also modular in that each wall module generally includes two support columns 50 and a rigid wall assembly 64 therebetween.

Figure 4H:
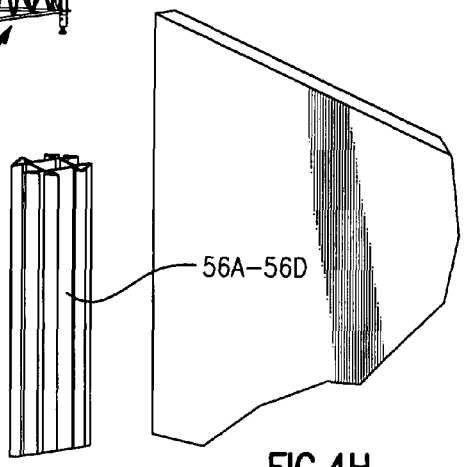
FIG. 4H is an exploded view of the rigid wall assembly prior to being mounted to the support column.
Figure 4I:
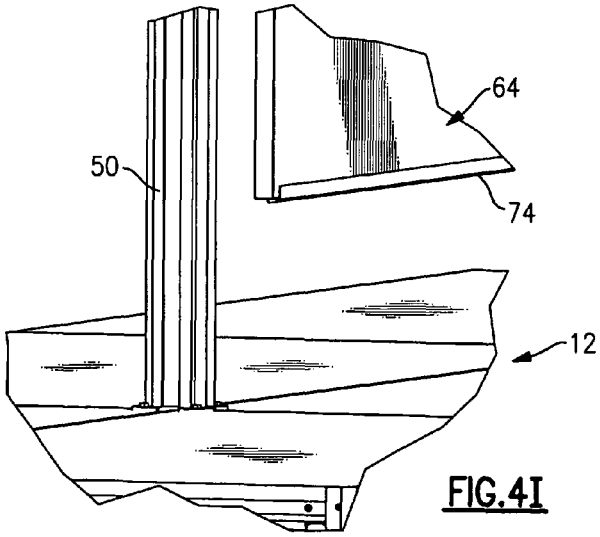
FIG. 4I is an expanded perspective view of the rigid wall assembly prior to mounting to the deck system.
Figure 4B:
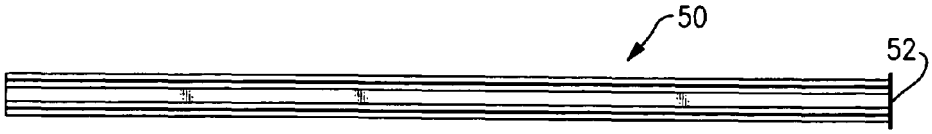
FIG. 4B is a side view of a support column.
Figure 4C:
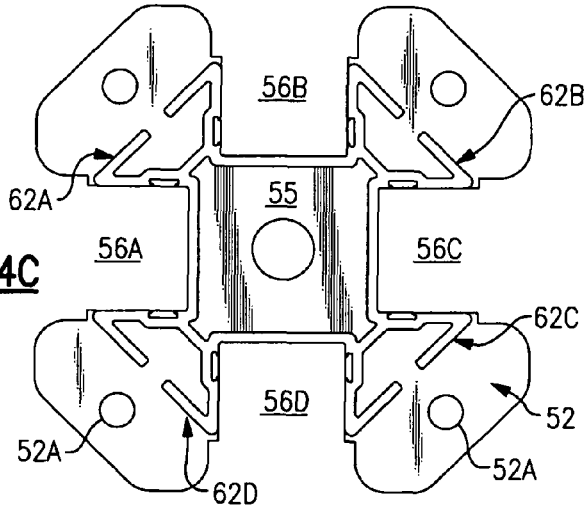
FIG. 4C is a top view of the support column.
Figure 4D:
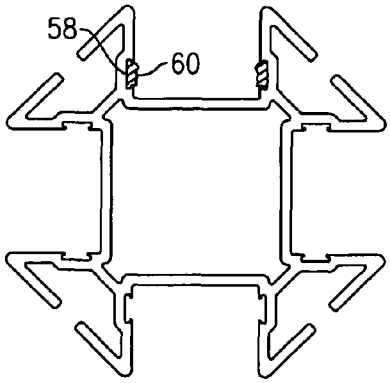
FIG. 4D is an expanded top view of a support column.

Referring to FIG. 4B, the support column 50 is a tubular generally rectilinear member in cross-section having a center opening 55 and a wall receipt slot 56A-56D on each side thereof (FIG. 4C). Each wall receipt slot 56A-56D preferably includes a seal slot 58 therein to receive seal 60 to assure a waterproof seal (FIG. 4D). Intermediate each wall receipt slot 56A-56D is an auxiliary area 62A-62D which permits running of conduits for electrical wiring, plumbing conduits as well as junction boxes, switch boxes or the like.

Each wall receipt slot 56A-56D is generally defined along each side of the support column 50 with the auxiliary area 62A-62D located at each corner to define a frustro-triangular cross-sectional area having the apex thereof is located at the corner of the support column. The support column 50 includes a column deck plate 52 having a set of deck plate apertures 52A (FIG. 4C) which corresponds with the deck attachment apertures 42 of the deck attachment plate 40 (FIG. 2B).

Figure 4E:
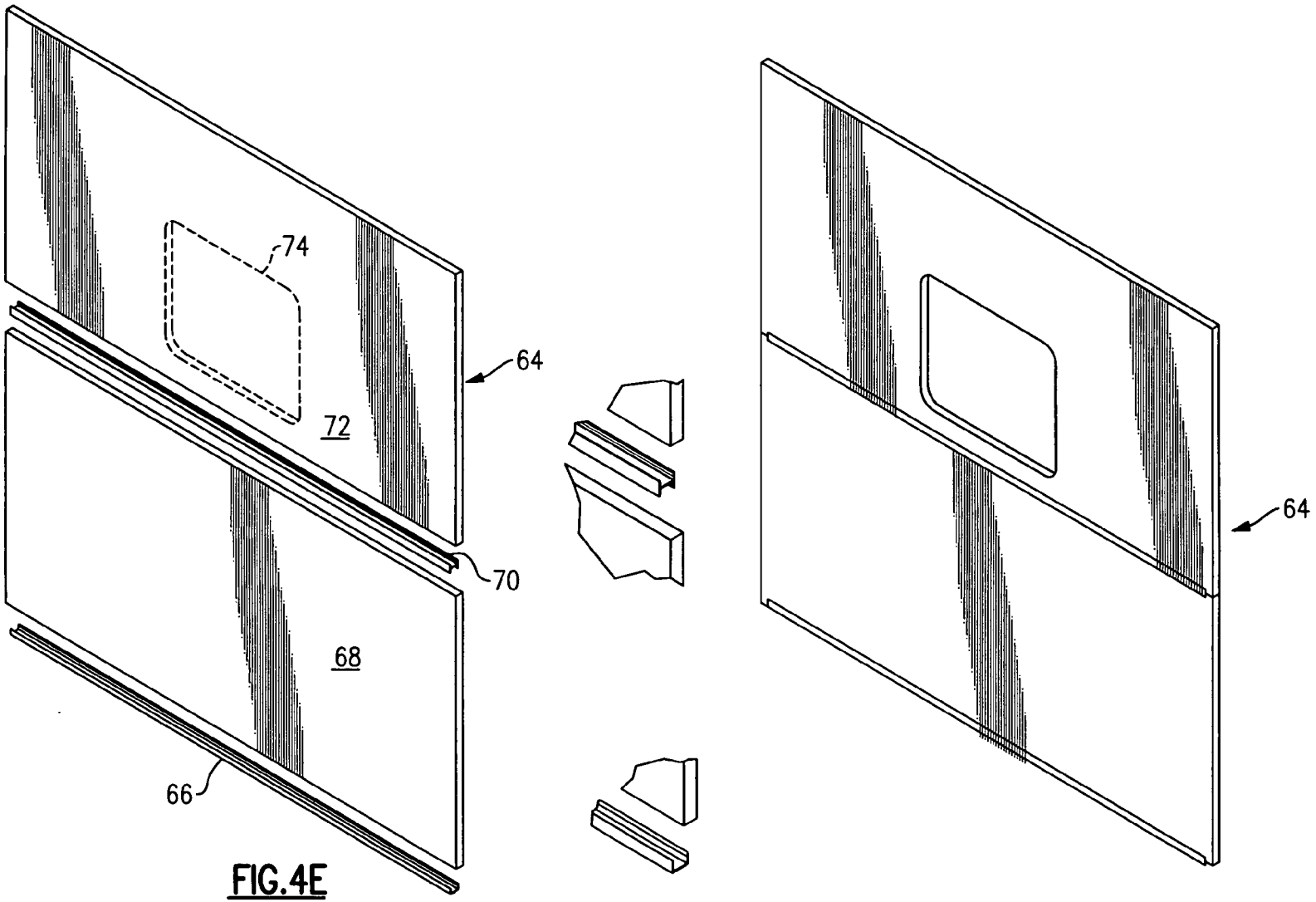
FIG. 4E is an exploded view of a rigid wall assembly.

Referring to FIG. 4E, each the rigid wall assembly 64 generally includes a lower panel extrusion 66, a lower panel 68, a center wall extrusion 70, and an upper panel 72. The lower panel 68 and the upper panel 72 are preferably of a sandwich construction manufactured with an aluminum skin over a rigid urethane foam core to combine light weight with high strength. The lower panel 68 and the upper panel 72 are preferably of equivalent dimensions and are interchangeable.

It should be understood that although a solid lower panel 68 and an upper panel 72 with a window 74 are disclosed in the illustrated embodiment, various panel types including window and non window panels are usable with the present invention. In addition, and prefabricated assemblies such as single door assemblies 64S (FIG. 1B), double door assemblies 64D (FIG. 1B), multi-door assemblies 64M (FIG. 1) as well as other prefabricated assemblies may also be installed between two support columns 50 to provide various structure features.

Figure 4F:
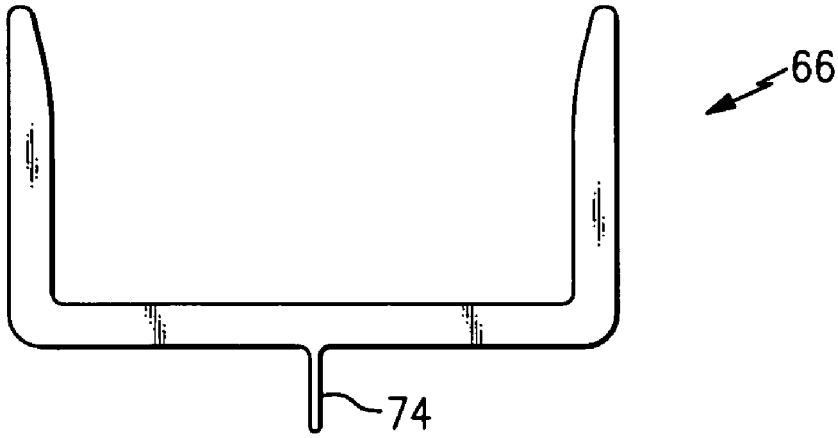
FIG. 4F is a sectional view of a lower panel extrusion of the rigid wall assembly.
Figure 4G:
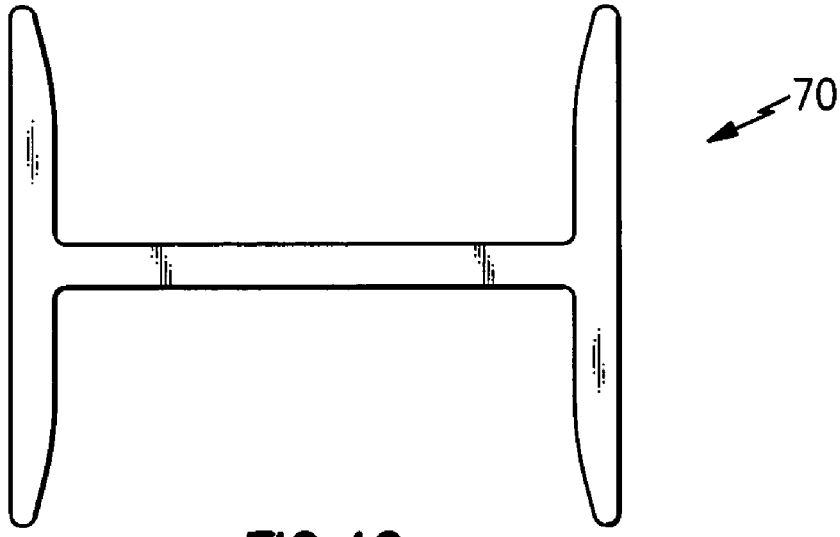
FIG. 4G is a sectional view of a center wall extrusion of the rigid wall assembly.

The lower panel extrusion 66 is generally U-shaped in cross section with a central tab 74 (FIG. 4F). The center wall extrusion 70 is generally I-shaped in cross section (FIG. 4G). The wall assembly 64 is readily assembled by mounting the lower panel extrusion 66 to a long side of the lower panel 68, the center wall extrusion 70 to the opposite side of the lower panel 68 then the upper panel 72 to the opposite side of the center wall extrusion 70. The lower panel 68 and the upper panel 72 are interference or friction fit into the respective lower panel extrusion 66 and the center wall extrusion 70. It should be understood that other resilient seals may additionally be provided.

Figure 1B:
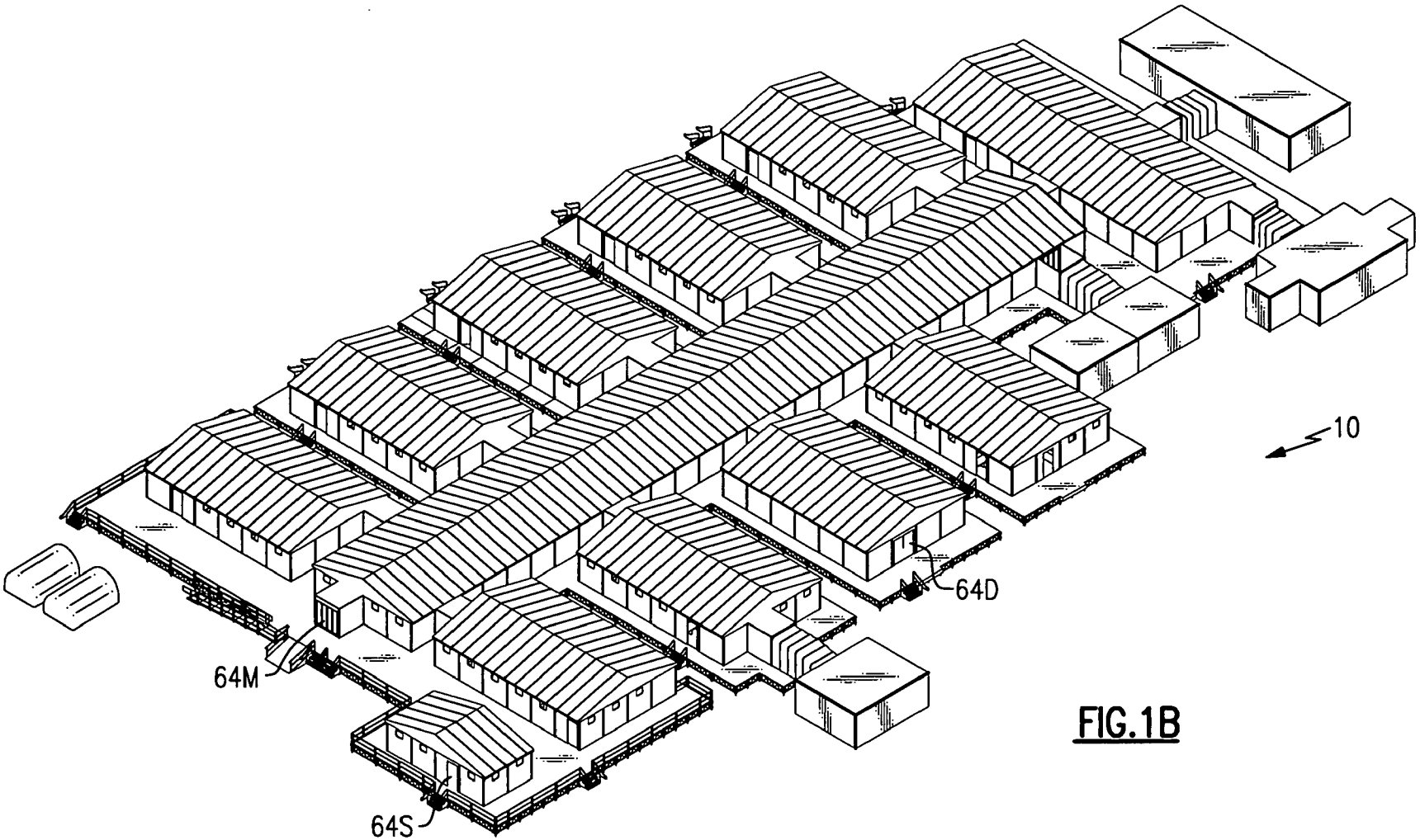
FIG. 1B is an exemplary multi-structure EITS system.

Once the deck system 12 has been assembled, the rigid wall system 14 is located thereon to define one or more structures S (FIGS. 1A and 1B). Each support column 50 is mounted to the deck system 12 such that fasteners f are located through the deck plate apertures 52A of the column deck plate 52, through the deck surface panel 24 and threaded into the deck attachment apertures 42 of the deck attachment plate 40 in the leg assembly 20 (FIG. 3). The rigid wall assembly 64 is then engaged with one of the wall receipt slots 56A-56D (FIG. 4H) and central tab 74 of the lower panel extrusion 66 is slid into the interface or gap between adjacent deck surface panels 24 (FIG. 4I). Such an interface adds further rigidity to the wall system 14 as well as structurally locking each the rigid wall assembly 64 to the deck system 12.

The next support columns 50 is then mounted to the deck system 12 and the rigid wall assembly 64 as described above. Such modular assembly is then repeated to assemble the rigid wall system 14 upon the deck system 12 to define the outer perimeter of the one or more structures S (FIG. 1B). Such assembly is relatively rapid due in part to the light weight of the components, their interchangeability and the grid-like pattern formed by the interface between adjacent deck surface panels 24 of the deck system 12.

Figure 5A:
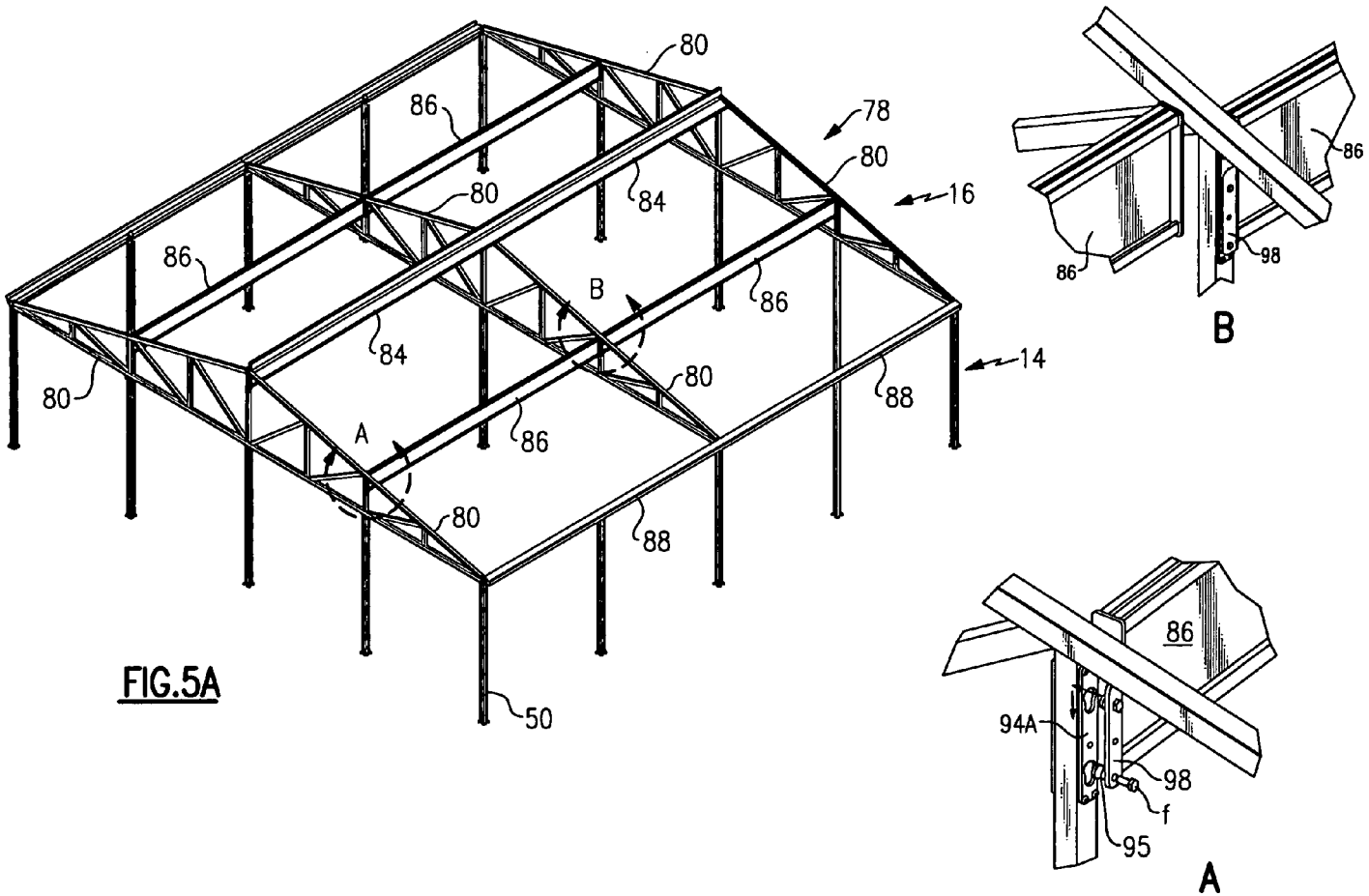
FIG. 5A is a perspective view of a roof support structure of a roof system.

Referring to FIG. 5A, once the rigid wall system 14 has been assembled, the roof system 16 is located thereon to finish the exterior of the structures S (FIGS. 1A and 1B). The roof system 16 generally includes a roof support structure 78 including a multiple of identical component parts which are assembled together in a modular manner. The roof support structure 80 includes at least one of a roof truss 82, a peak purlin 84, a roof intermediate purlin 86 and a wall cap soffit 88.

Figure 5D:
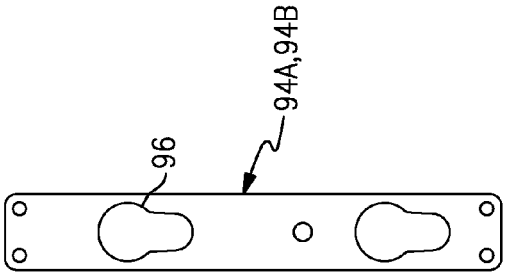
FIG. 5D is an expanded face view of a purlin attachment plate.
Figure 5B:
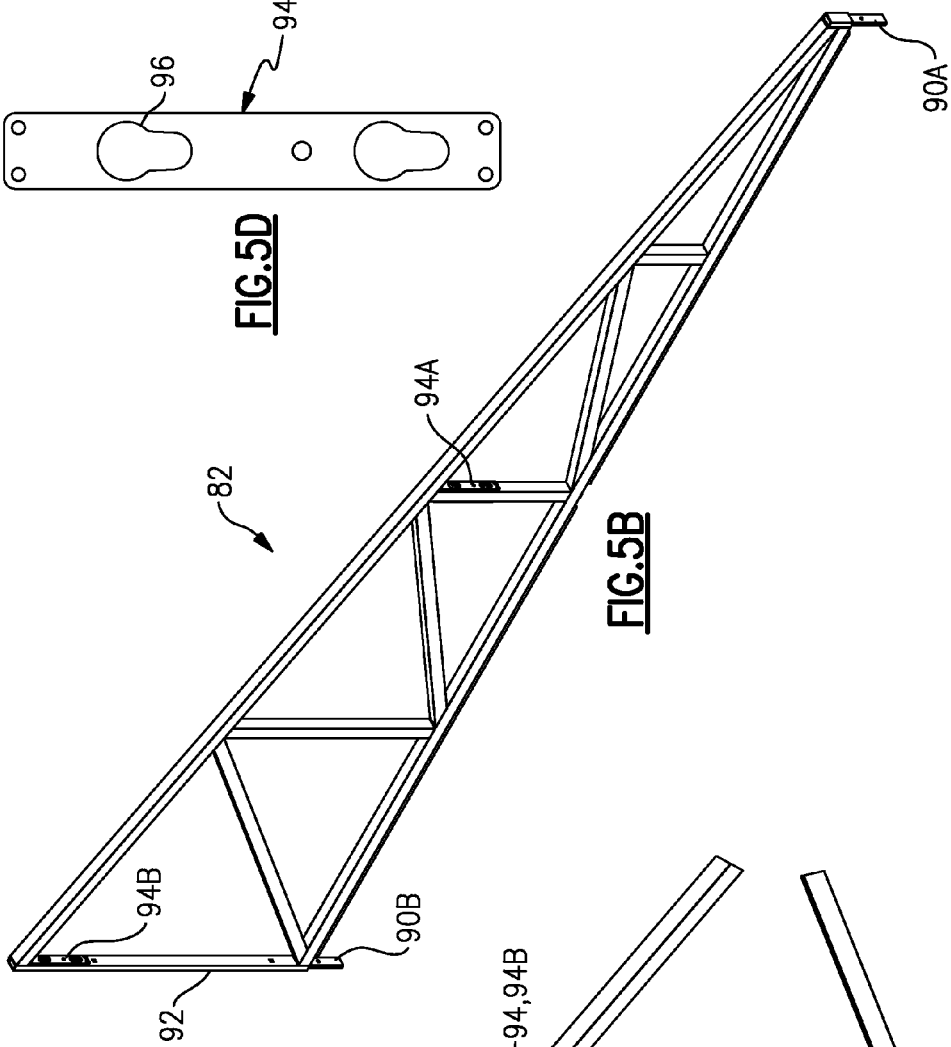
FIG. 5B is a perspective view of a roof truss.
Figure 5C:
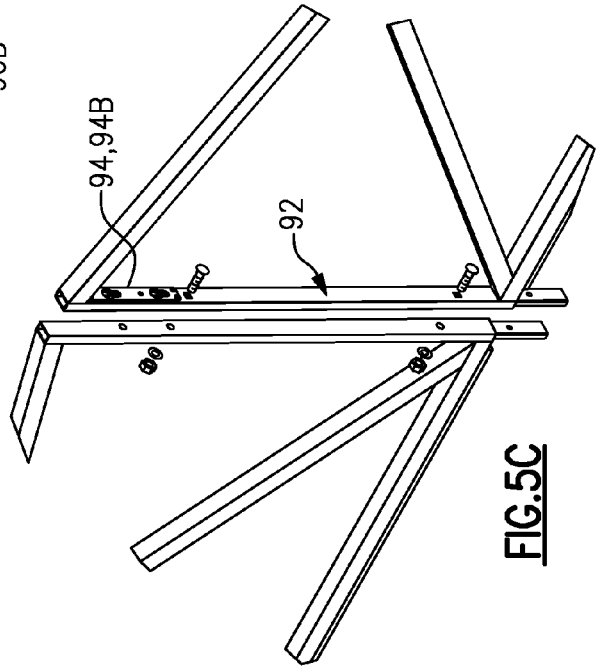
FIG. 5C is an exploded view of the roof truss attachable to another roof truss to form a peaked roof.

Referring to FIG. 5B, the roof truss 82 is a generally triangular member having roof truss end tabs 90A, 90B and a purlin attachment plate 94A, 94B (also illustrated in FIG. 5D). The roof truss 82 is preferably sized to fit within a shipping container and is approximately 16 feet in length, however, trusses of other sizes are also usable with the present invention. Preferably, two roof trusses 82 are attached together (FIG. 5C) to form a peaked roof.

Figure 5E:
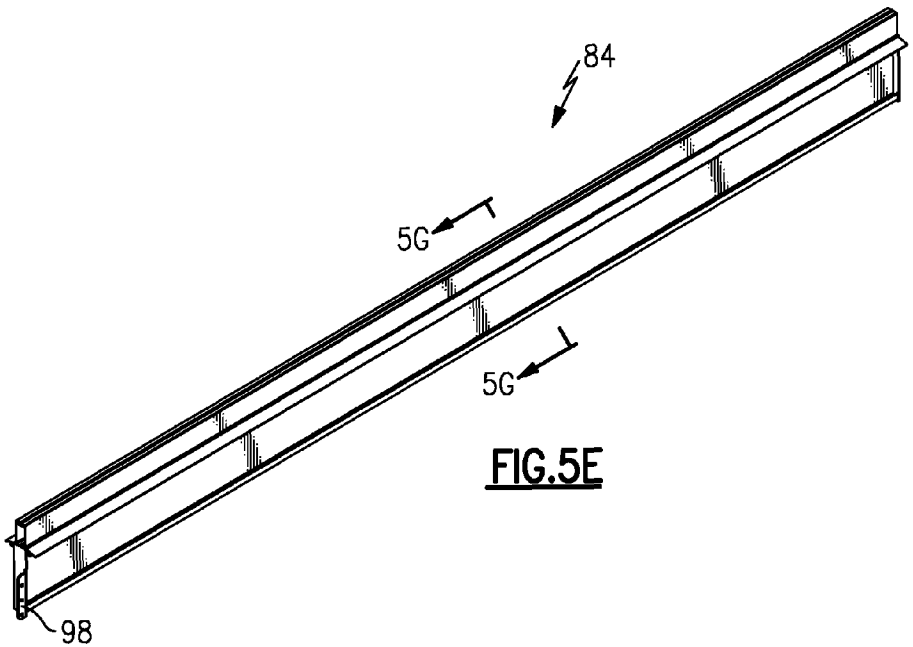
FIG. 5E is a perspective view of a peak purlin.
Figure 5F:
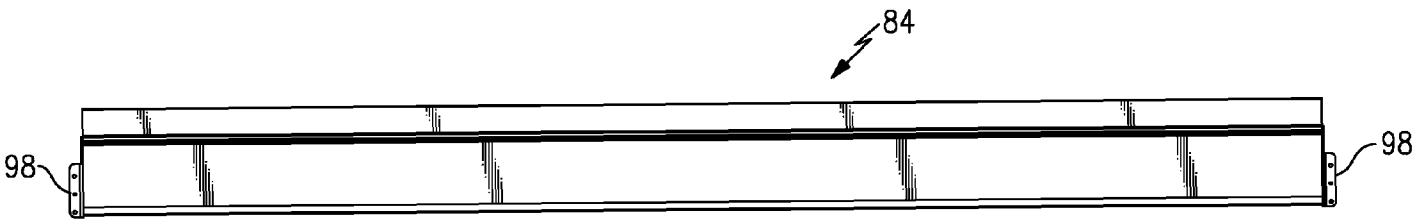
FIG. 5F is a side view of the peak purlin.
Figure 5G:
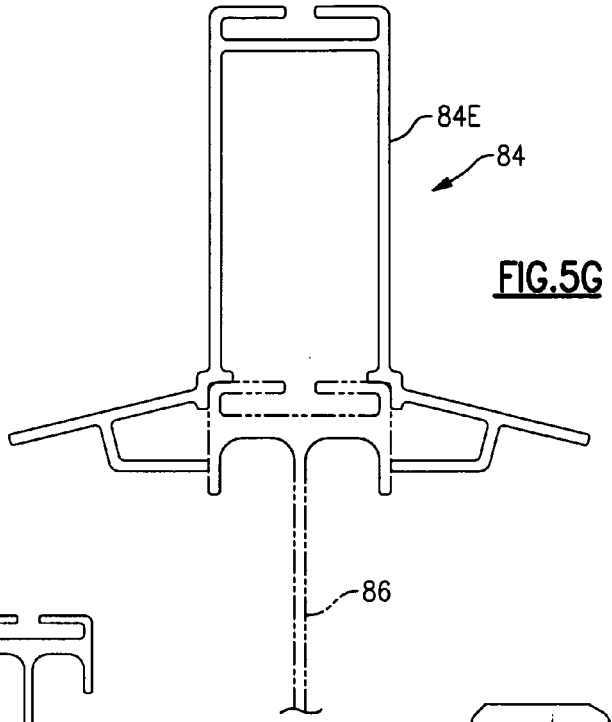
FIG. 5G is a sectional view transverse to the length of the peak purlin.
Figure 5J:
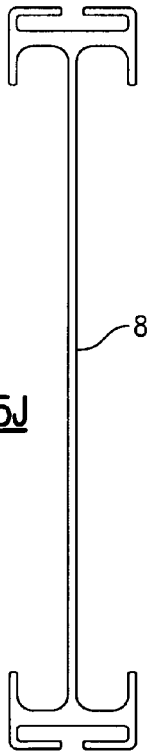
FIG. 5J is a sectional view transverse to the length of the intermediate purlin.
Figure 5K:
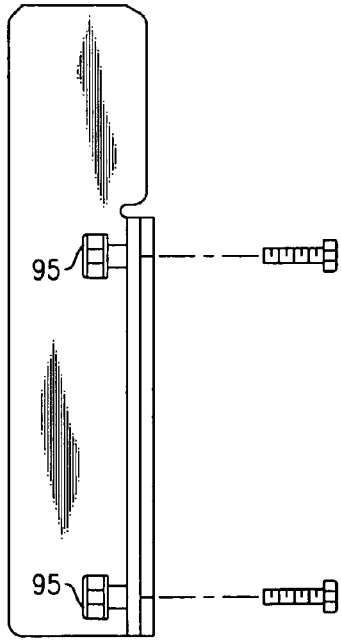
FIG. 5K is a side view of an end attachment bracket of a purlin end attachment bracket.
Figure 5H:
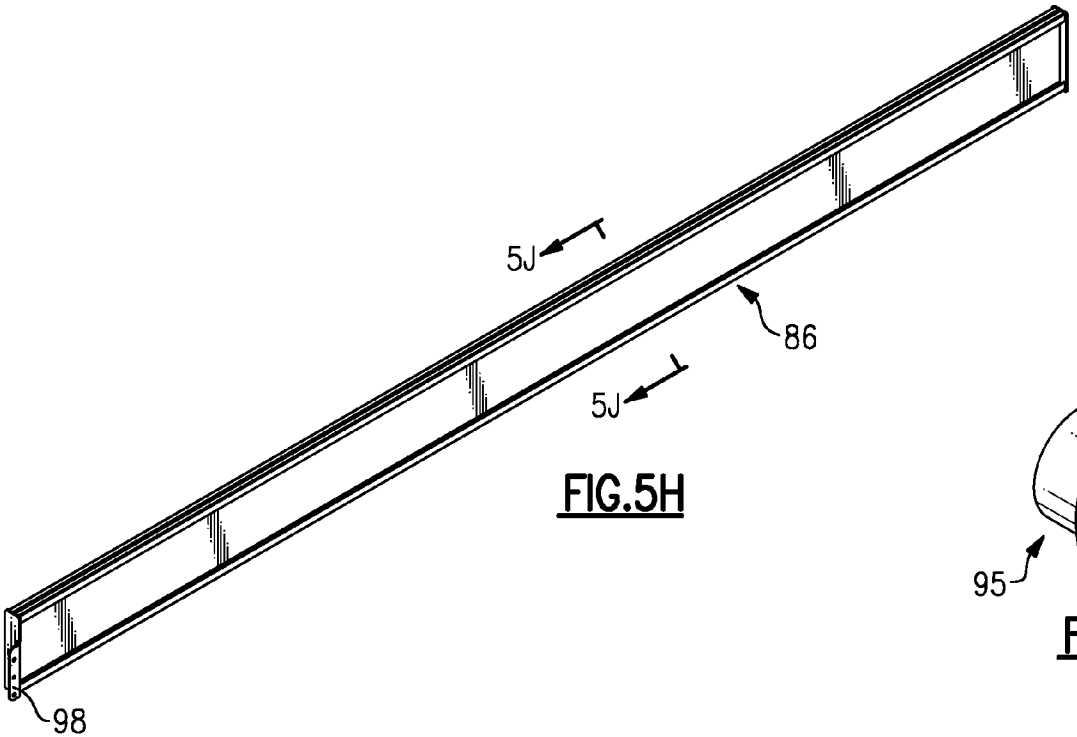
FIG. 5H is a perspective view of an intermediate roof purlin.
Figure 5L:
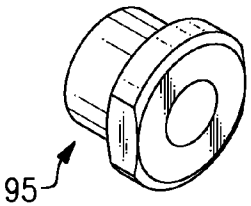
FIG. 5L is a perspective view of a purlin attachment stud.
Figure 5I:
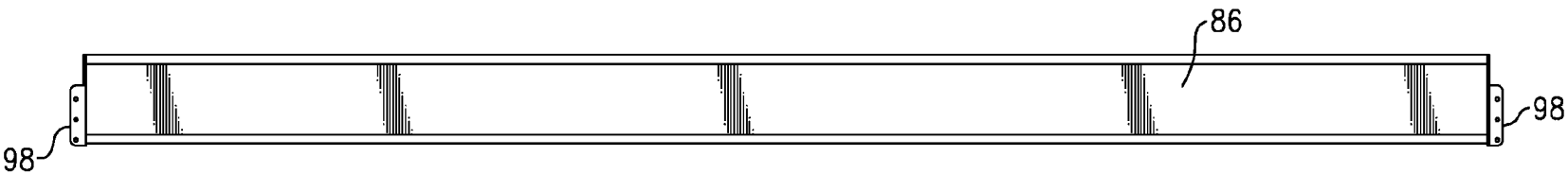
FIG. 5I is a side view of the intermediate roof purlin.

The roof center attachment plate 92 and the purlin attachment plates 94A, 94B include a multitude of key hole apertures 96. Each peak purlin 84 (also illustrated in FIGS. 5E-5G) and roof intermediate purlin 86 (also illustrated in FIGS. 5H-5J) include end attachment brackets 98 which are engageable with the multitude of key hole apertures 96 of the respective purlin attachment plates 94A, 94B (FIG. 5A). Preferably, the end attachment brackets 98 are located at the end of, and on opposed sides of, the peak purlin 84 and roof intermediate purlin 86 such that adjacent peak purlins 84 and roof intermediate purlins 86 sandwich vertical truss support members therebetween. The end attachment brackets 98 are mounted to the purlin attachment plates 94A, 94B with an attachment stud 95 which engages the keyhole apertures 96 and a fastener (FIGS. 5K and 5L).

Figure 6A:
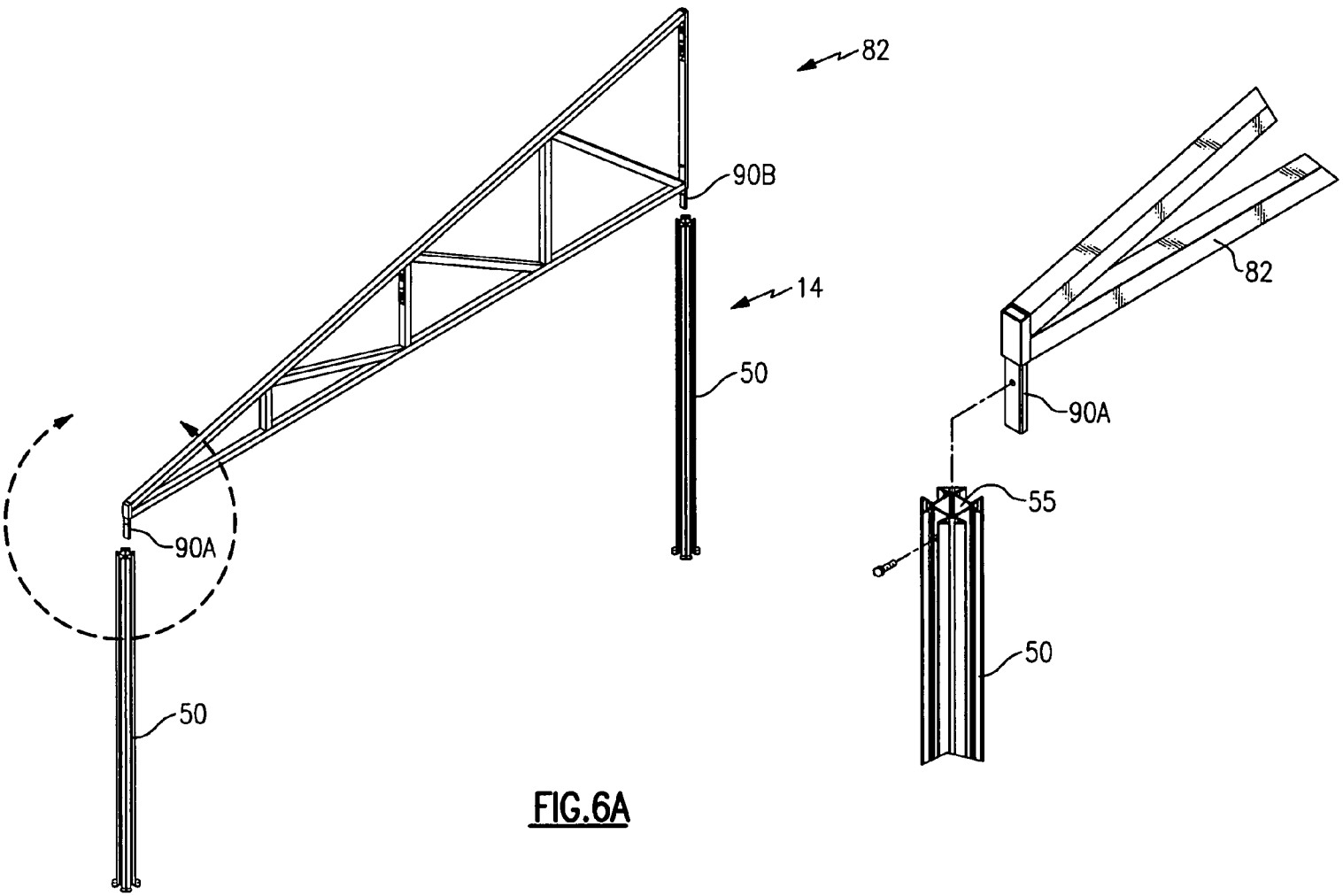
FIG. 6A is an exploded view of a roof truss relative to the support columns.
Figures 6B, 6C:
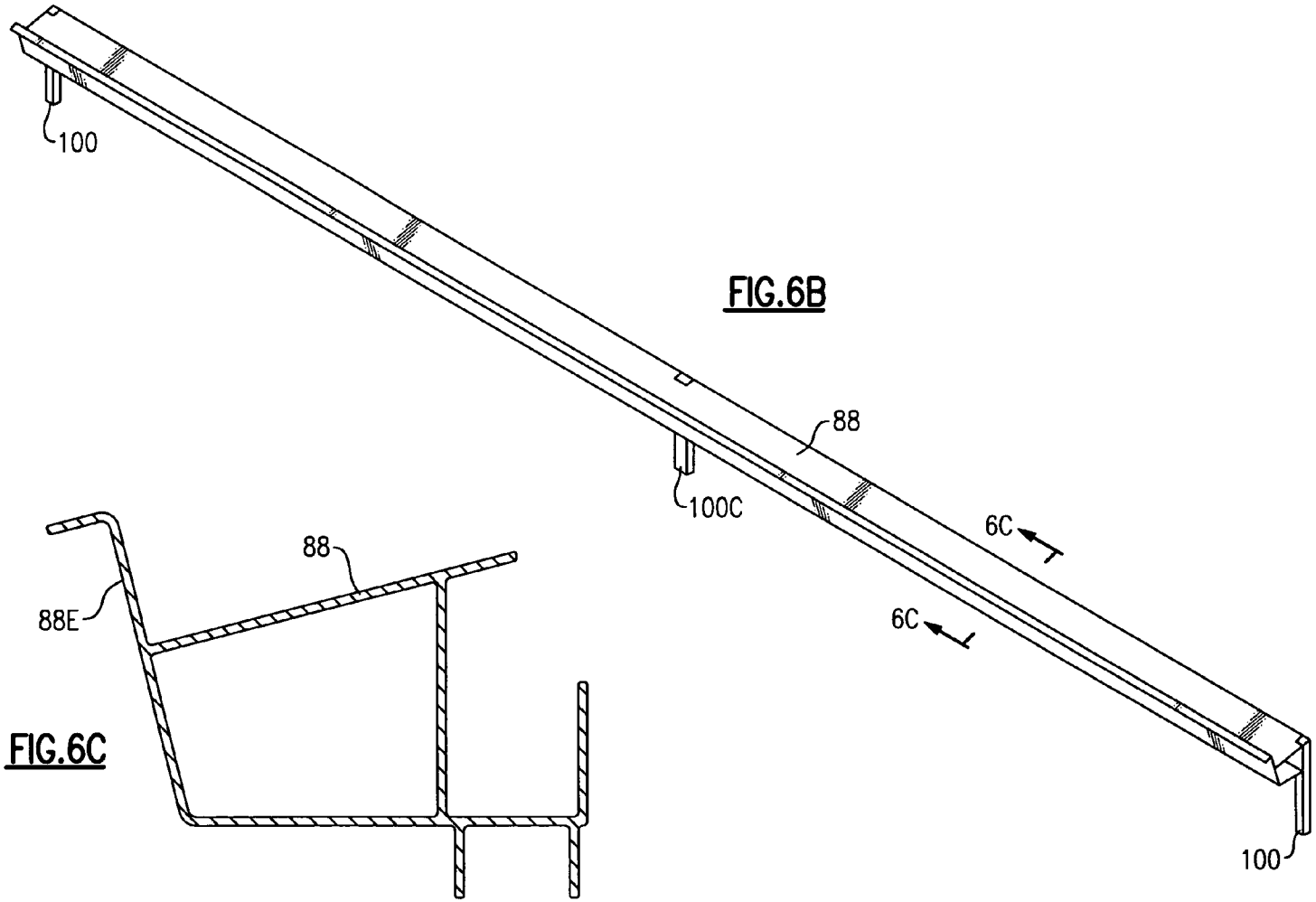
FIG. 6B is a perspective view of a wall cap soffit.
FIG. 6C is a sectional view through a longitudinal length of the wall cap soffit.
Figure 6D:
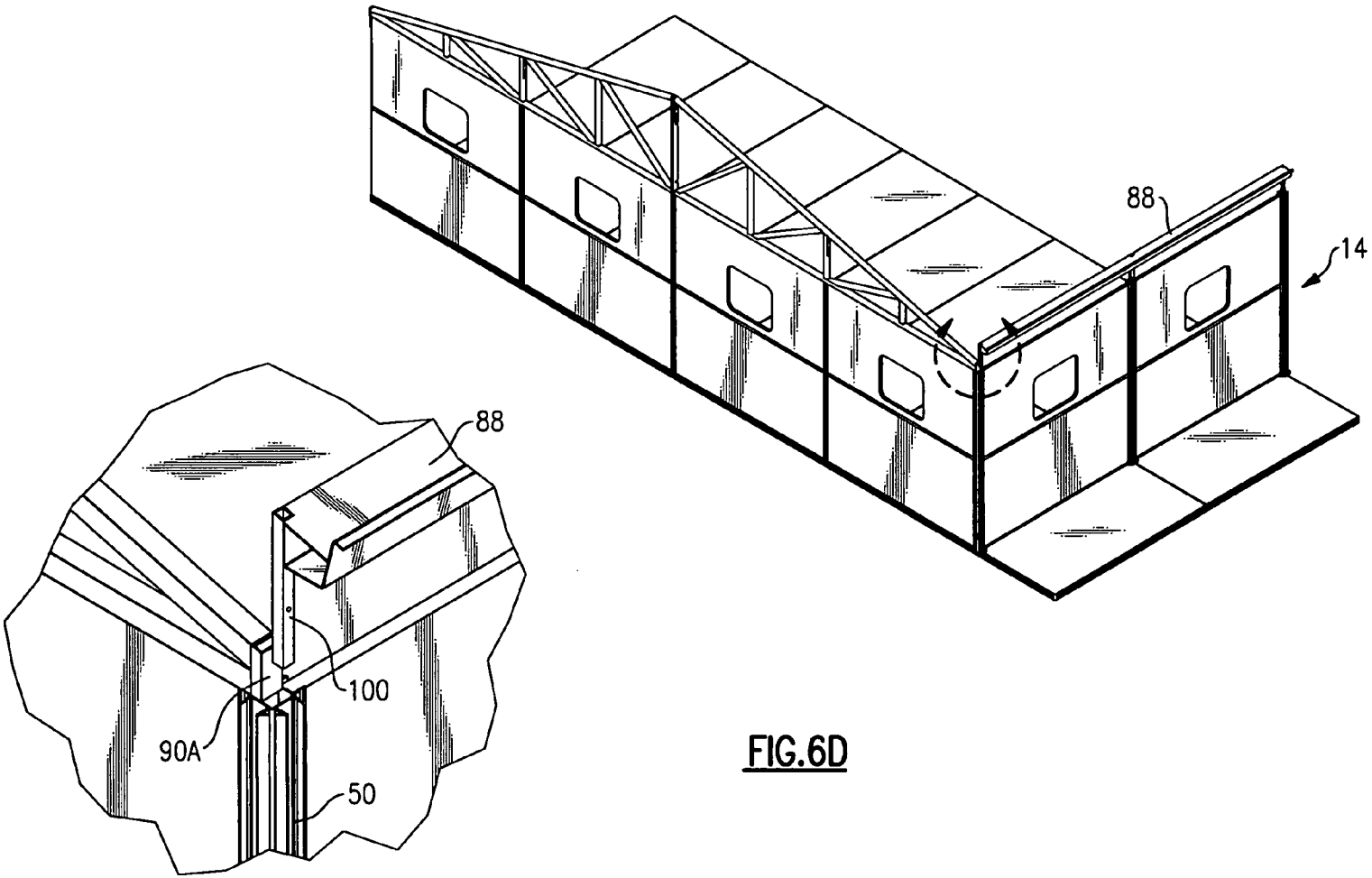
FIG. 6D is an exploded view of a wall cap soffit prior to assembly to the rigid wall system.

Referring to FIG. 6A, to assemble the roof support structure 78 to the rigid wall system 14, the roof truss end tabs 90A, 90B are located into the center opening 55 of two support columns 50 and are preferably fastened in place with bolts or the like. Each roof truss 82 is attachable to an adjacent roof truss 82 at adjacent roof center attachment plates 92 (FIG. 5A). That is, the roof truss end tabs 90A, 90B are located into the center opening 55 of the support columns 50 and two adjacent roof trusses 82 are locked together at the roof center attachment plates 92. The wall cap soffit 88 (FIGS. 6B and 6C) is then mounted to the top of the rigid wall system 14 transverse to the roof truss 82 along the length thereof such that each wall cap soffit tab 100 is fitted within the center opening 55 of the support columns 50 (FIG. 6D). Notably, the end wall cap soffit tab 100 is half the width of the center wall cap soffit tab 100 which completely fills the center opening 55 of the support column 50 as the end wall cap soffit tabs 100 will interface with other tabs such as those of the roof truss 82 or of an adjacent wall cap soffit 88. Once the roof support structure 80 is assembled to the rigid wall system 14, a multitude of roof panels 102 are locate thereon (FIG. 7A).

Figure 7A:
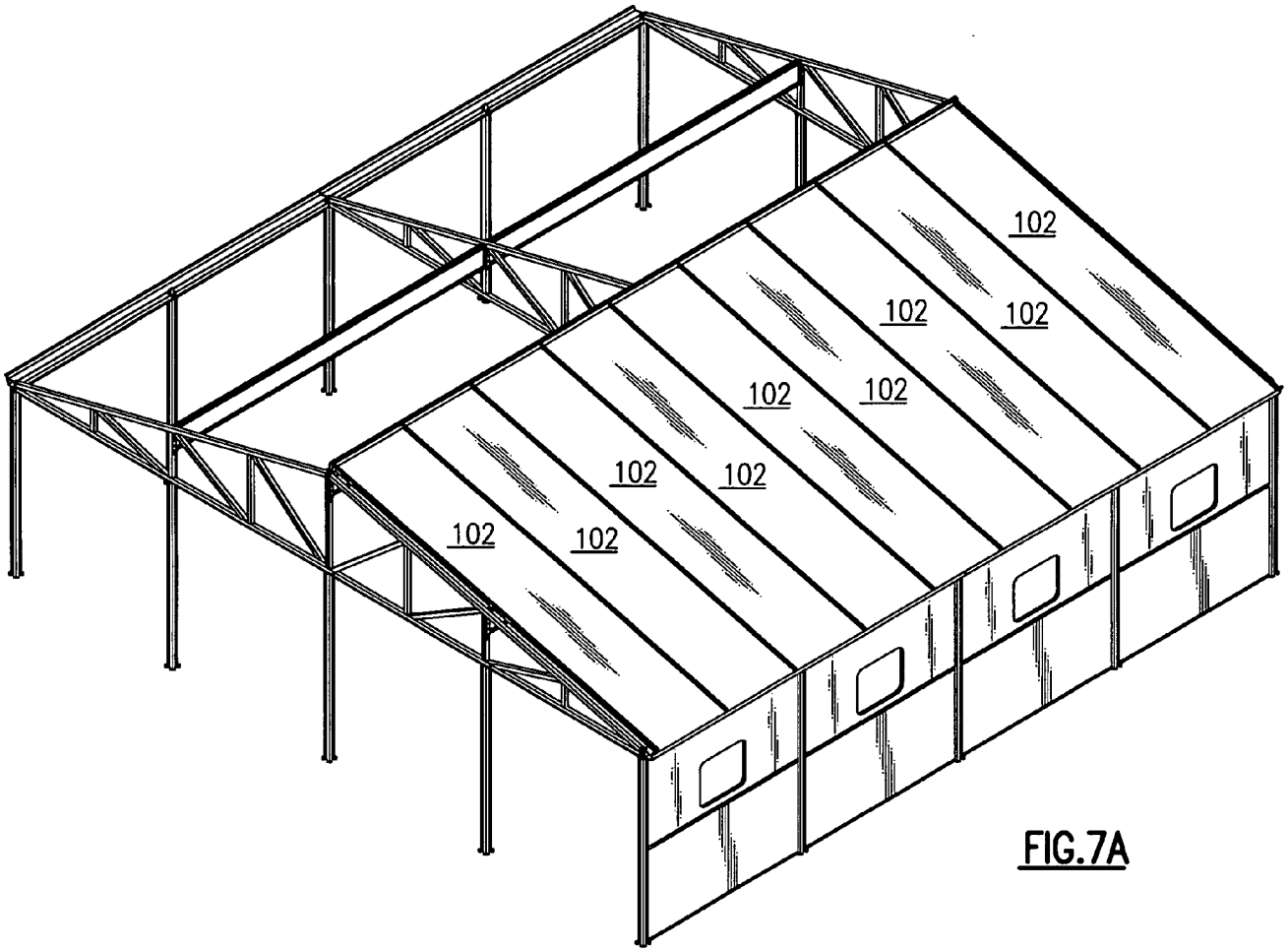
FIG. 7A is a perspective view of a roof system with roof panels mounted.
Figure 7B:
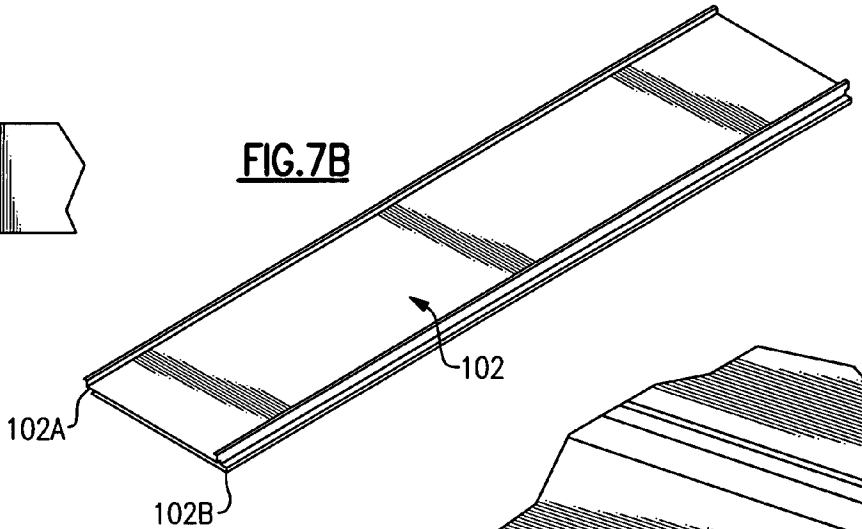
FIG. 7B is a perspective view of a roof panel.
Figure 7D:
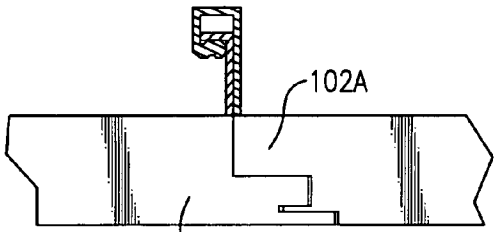
FIG. 7D is an assembled view of two roof panels.
Figure 7C:
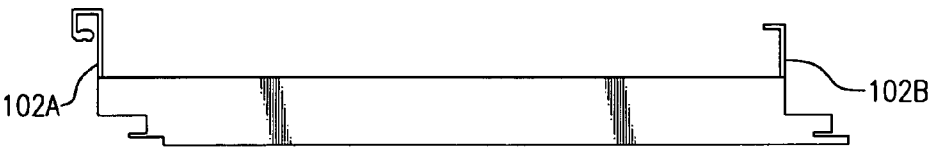
FIG. 7C is an end view of a roof panel illustrating a male and female attachment side thereof.
Figure 7E:
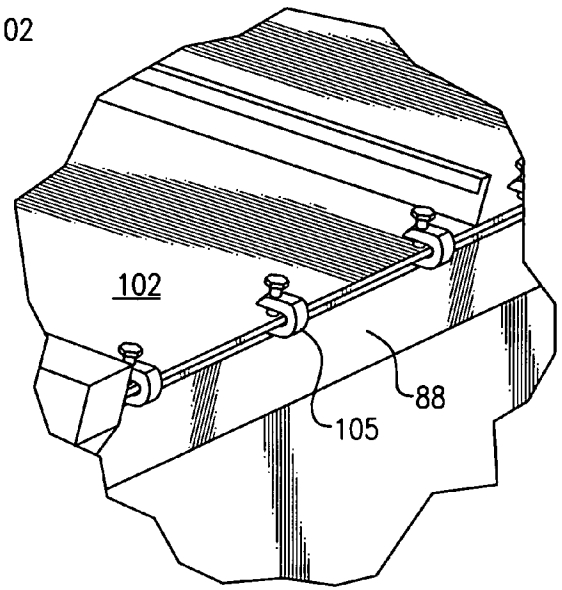
FIG. 7E is an edge view of the roof panel attachment.

Referring to FIG. 7A, the roof panels 102 are located between the peak purlin 84 and the wall cap soffit 88. The roof panels 102 are retained between a wall cap soffit edge 88E of the wall cap soffit 88 (FIG. 6E) and a raised center member 84E of the peak purlin 84 (FIG. 5G) and interface with adjacent roof panels 102 at an overlapping roof panel interface 104. That is, each roof panel 102 includes a male raised edge 104 which engages within a female raised edge 106. The raised overlapping roof panel interface 104 covers a stepped interface 108 with a seal member 110 which slips into a slot 112 on an opposite side of an adjacent roof panel 102. The adjacent roof panels 102 essentially just slide into engagement with each other (FIG. 7D) to provide a watertight yet readily assembled interface. That is, each roof panel 102 is identical with a first edge 102A and a second edge 102B. The first edge 102A of one roof panel 102 engages a second edge 102B of an adjacent roof panel 102. The roof panels 102 are preferably attached to the wall cap soffit 88 with a multitude of roof panel clips 105 preferably three per roof panel 102 which engage an edge of the wall cap soffit 88E (FIG. 6C).

Figure 8A:
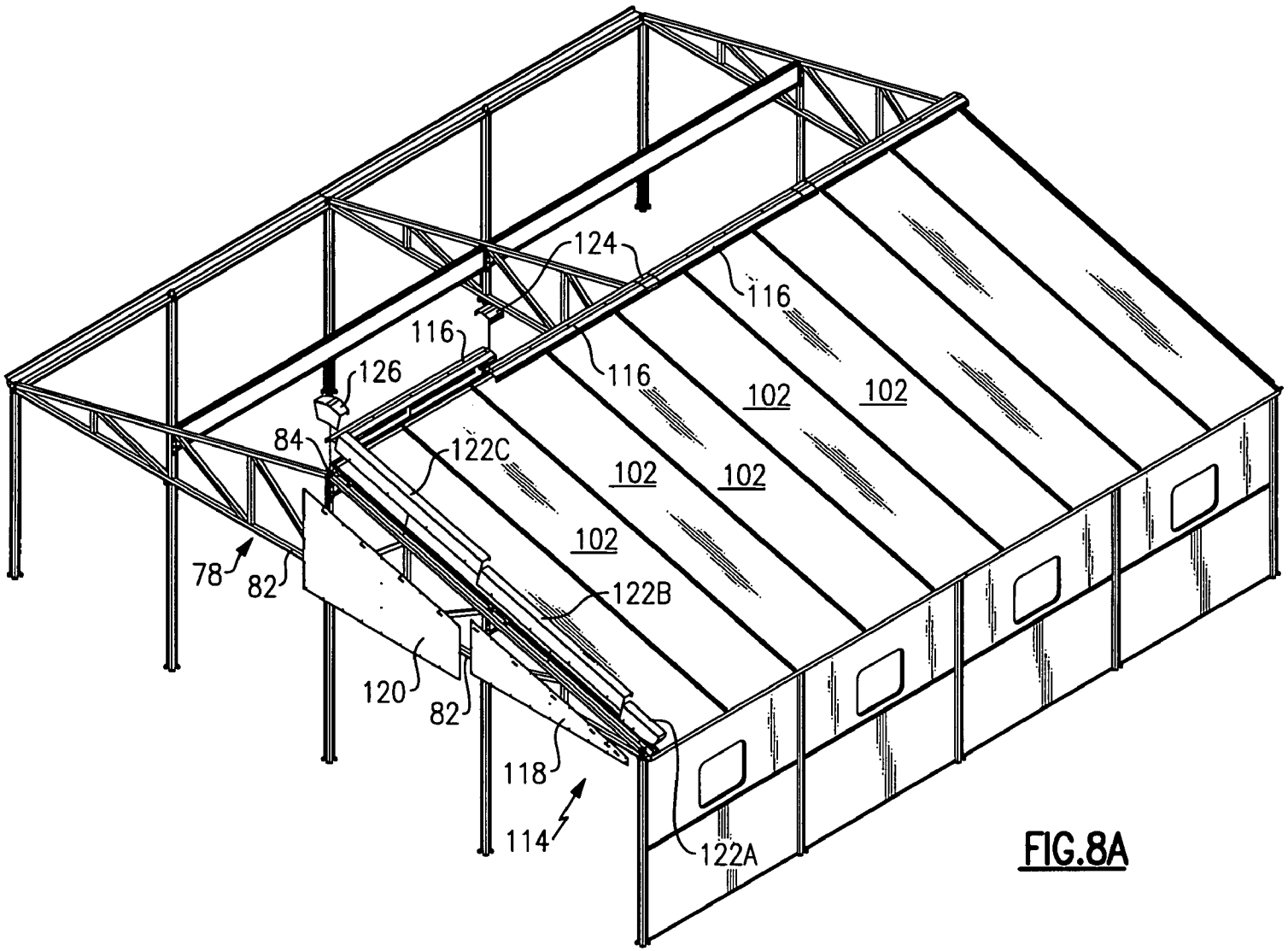
FIG. 8A is an exploded view of a roof cap system.
Figure 8B:
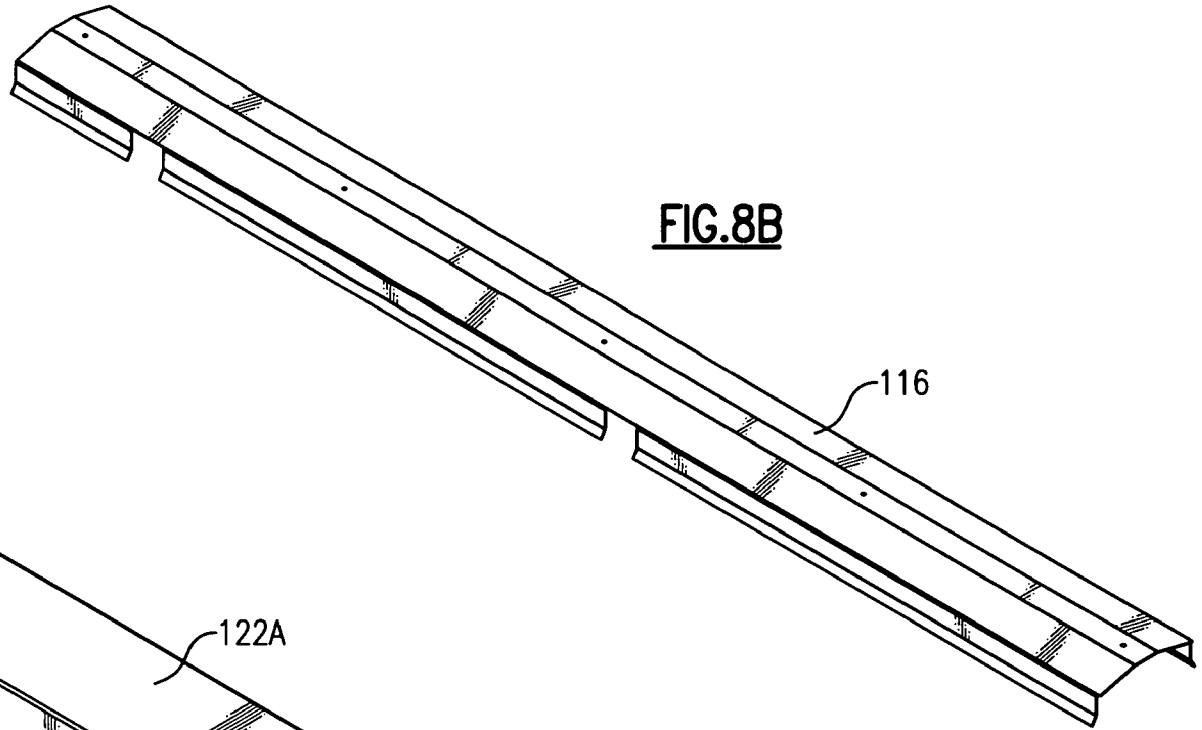
FIG. 8B is a perspective view of a roof cap.
Figure 8C:
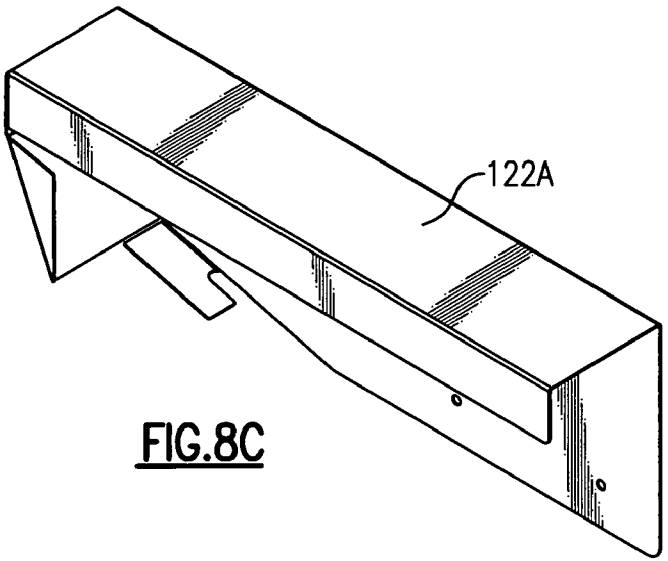
FIG. 8C is a perspective view of a roof gable end soffit cap.
Figure 8D:
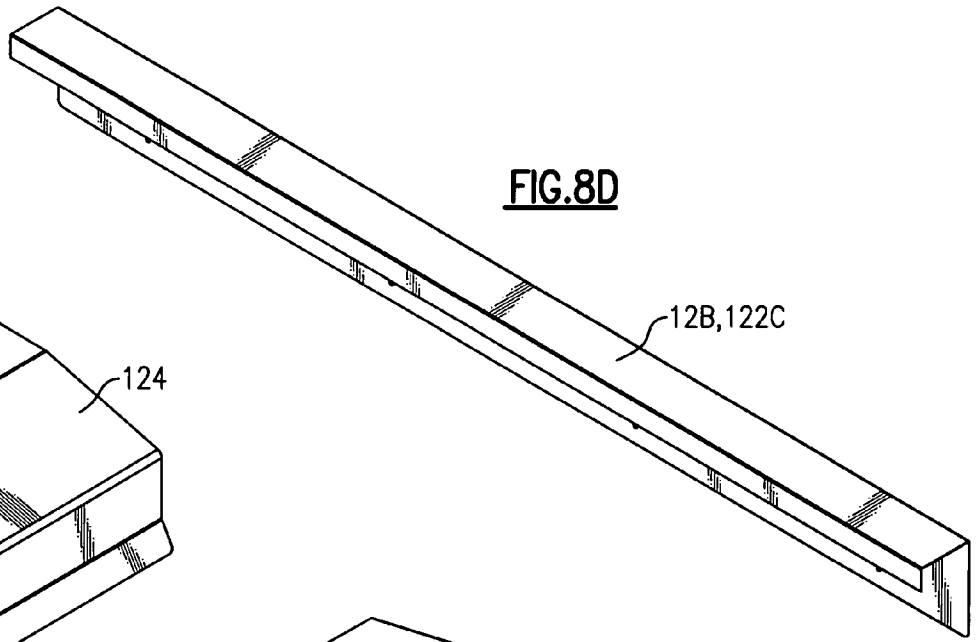
FIG. 8D is a perspective view of a roof gable end cap.
Figure 8F:
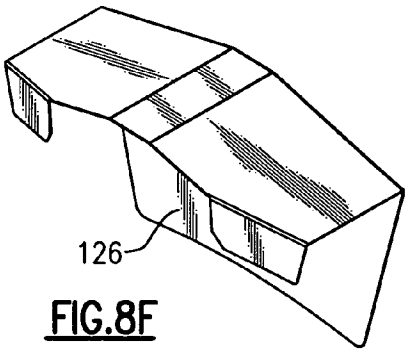
FIG. 8F is a perspective view of a roof cap end.
Figure 8E:
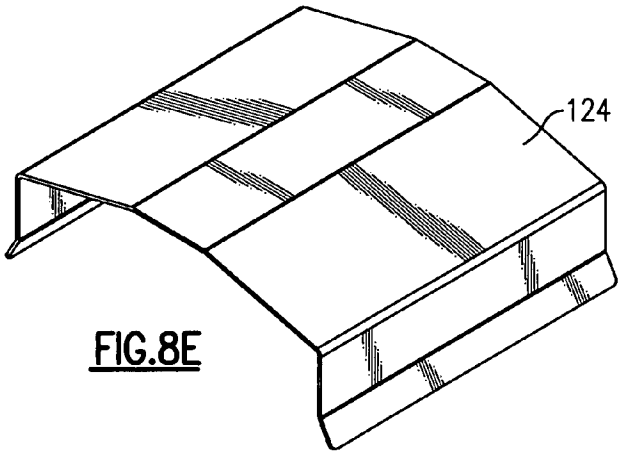
FIG. 8E is a perspective view of an intermediate roof cap.

Referring to FIG. 8A, once the multitude of roof panels 102 are located on the roof support structure 78, a roof cap system 114 is mounted over the edge interfaces of the roof panels 102 and the roof support structure 78. A multitude of ridge caps 116 (FIG. 8B) are located along the peak purlin 84 and fastened in place through screws or the like which engage the top center slot of the peak purlin (FIG. 5G). Truss sheeting 118, 120 is then fastened to the exposed side of each external roof truss 82. Preferably, the truss sheeting 118, 120 is pre-attached to the exposed side of the trusses with rivets or the like prior to shipment to further streamline on-site assembly. A multitude of roof gable end soffit caps 122A-122C (FIGS. 8C and 8D) are then locate over the interface between the roof panel 102 which abuts the end roof truss 82 and fastened thereto. The roof gable end soffit caps 122A-122C are preferably attached to the truss sheeting 118, 120 on the side of the roof trusses 82 to minimize attachments through the upper surfaces. Finally, ridge joint caps 124 (FIG. 8E) are located over the interface between adjacent ridge caps 116 and a roof cap end 126 (FIG. 8F) is located at the apex intersection to cover the interface between the ridge caps 116 and the roof gable end soffit caps 122C. A watertight system is thereby rapidly assembled.

Figure 9A:
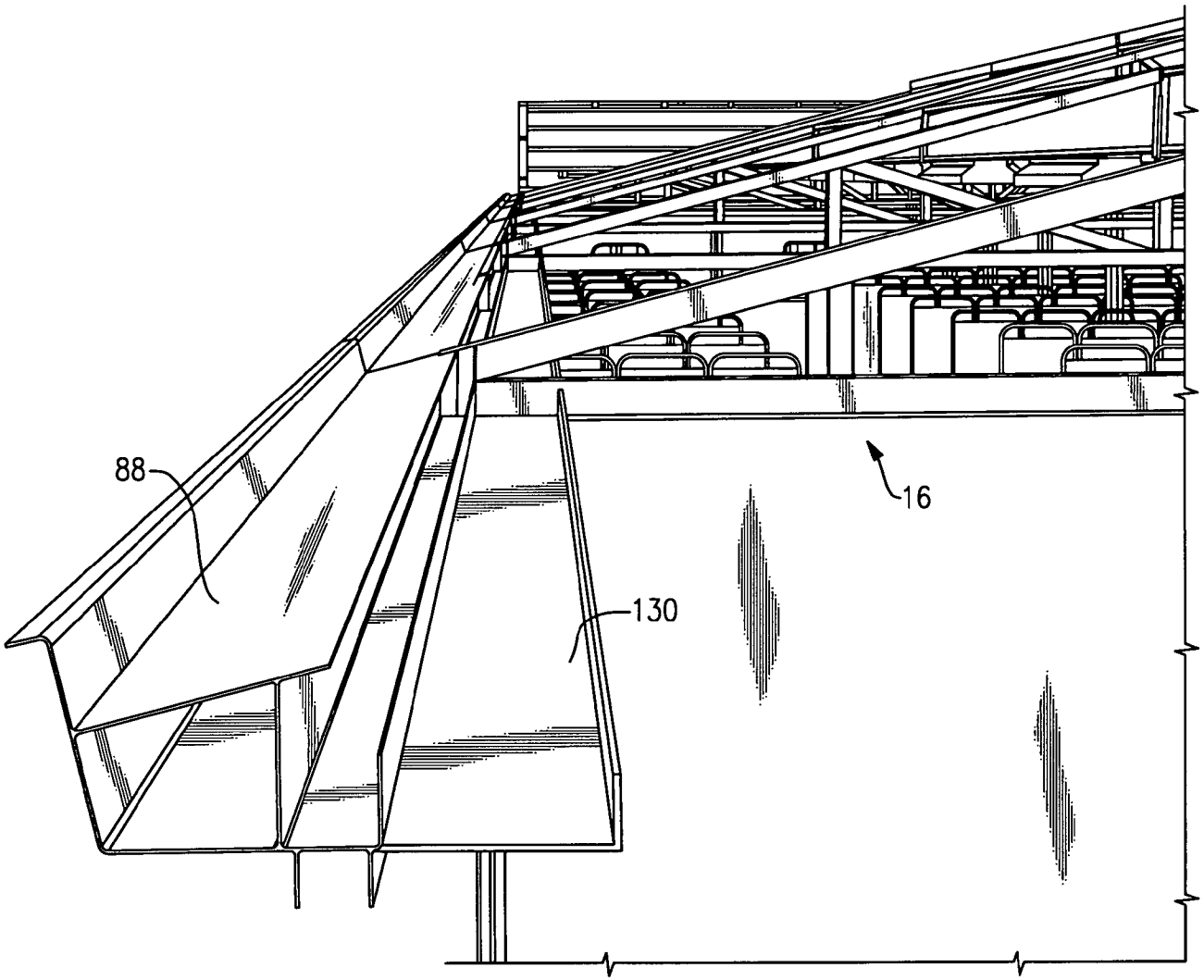
FIG. 9A is an internal perspective view of a transport channel a roof system.
Figure 9B:
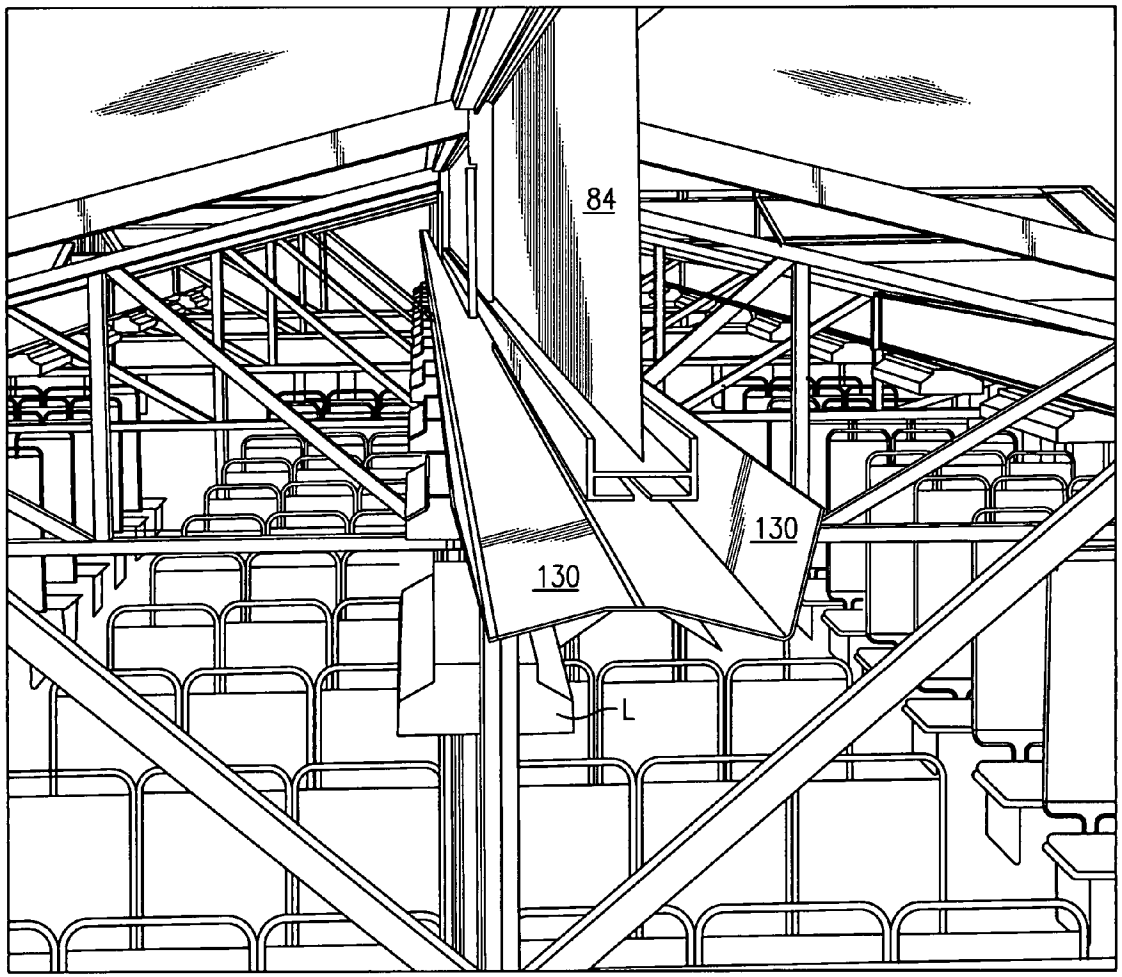
FIG. 9B is an internal perspective view of a transport channel a roof system.
Figure 9C:
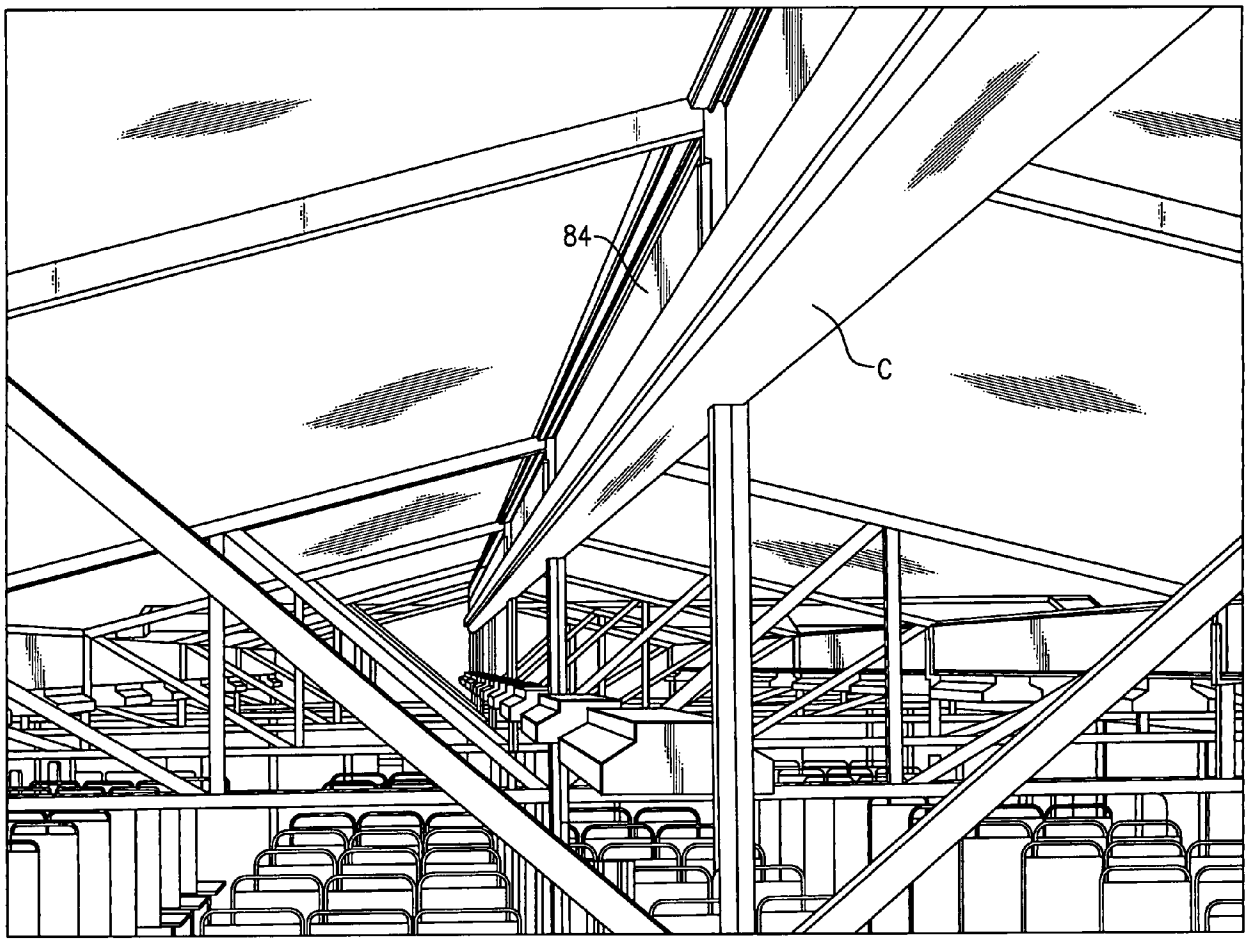
FIG. 9C is a perspective view of a HVAC conduit within the roof system.

Referring to FIG. 9A, an internal view of the roof system 16 illustrates a transport channel 130 located along the length of the wall cap soffit 88 and along each side of the peak purlin 84 (FIG. 9B). The transport channel 130 provides support and storage area for the running of wires, water supply conduits, and the like to provide an unencumbered floor area. The wires, water supply conduits, and the like are simply located within the transport channel 130 then run down the auxiliary area 62A-62D within the support columns 50 for communication to the desired location. For example only, wires may be run from light fixtures L along the transport channel 130, down the auxiliary area 62A-62D within the support column 50 and to a junction box or switch box. Wiring and plumbing is therefore readily installed within the structure. Environmental conditioning transport conduits such as HVAC tubular conduits C may likewise be run along the transport channel 130 as well as mounted directly to the truss beams 82 (FIG. 9C).

It should be understood that relative positional terms such as "forward," "aft," "upper," "lower," "above," "below," and the like are with reference to the normal operational attitude of the vehicle and should not be considered otherwise limiting.

It should be understood that although a particular component arrangement is disclosed in the illustrated embodiment, other arrangements will benefit from the instant invention.

Although particular step sequences are shown, described, and claimed, it should be understood that steps may be performed in any order, separated or combined unless otherwise indicated and will still benefit from the present invention.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A deck unit module comprising:

a multitude of adjustable leg assemblies, each of said multitude of adjustable leg assemblies includes an upper truss attachment flange and a lower truss attachment flange which extends radially therefrom, said upper truss attachment flange and said lower truss attachment flange including a multiple of truss attachment apertures;

a lower truss attachable to at least two of said multitude of adjustable leg assemblies said lower truss including an upper attachment hook and a lower attachment hook engageable with one of said multiple of truss attachment apertures in said respective upper truss attachment flange and said lower truss attachment flange; and a deck surface panel supported on at least two of said multitude of adjustable leg assemblies and said lower truss.

2. The module as recited in claim 1, wherein said multitude of adjustable leg assemblies include four adjustable leg assemblies.

3. The module as recited in claim 1, wherein each of said multitude of adjustable leg assemblies includes an intermediate leg telescopically mounted to a primary leg, and a foot telescopically mounted to said intermediate leg.

4. The module as recited in claim 3, wherein said foot is telescopically mounted to said intermediate leg through a threaded interface.

5. The module as recited in claim 1, wherein said multitude of truss attachment apertures are mounted at forty-five (45) degree increments about said leg assembly.

6. The module as recited in claim 1, wherein said upper attachment hook and said lower attachment hook, hook into one of said multiple of truss attachment apertures in said respective upper truss attachment flange and said lower truss attachment flange.

7. A deck system comprising:

a first adjustable leg assembly includes a first upper truss attachment flange and a first lower truss attachment flange which extends radially therefrom, said first upper truss attachment flange and said first lower truss attachment flange including a multiple of truss attachment apertures;

a second adjustable leg assembly includes a second upper truss attachment flange and a second lower truss attachment flange which extends radially therefrom, said second upper truss attachment flange and said second lower truss attachment flange including a multiple of truss attachment apertures;

a lower truss attachable to said first adjustable leg assembly and said second adjustable leg assembly, said lower truss including a first upper attachment hook, a second upper attachment hook, a first lower attachment hook and a second lower attachment hook, said first upper attachment hook and said first lower upper attachment hook engageable with one of said multiple of truss attachment apertures in said respective first upper truss attachment flange and said first lower truss attachment flange and said second upper attachment hook and said second lower upper attachment hook engageable with one of said multiple of truss attachment apertures in said respective second upper truss attachment flange and said second lower truss attachment flange;

a first deck surface panel at least partially supported on said first adjustable leg assembly, said second adjustable leg assembly and said lower truss; and a second deck surface panel adjacent to said first deck surface panel and at least partially supported on said first adjustable leg assembly, said second adjustable leg assembly and said lower truss.

8. The system as recited in claim 7, wherein said truss at least partially supports said first deck surface panel and said second deck surface panel.

9. The system as recited in claim 7, wherein each of said first adjustable leg assembly and said second adjustable leg assembly includes an intermediate leg telescopically mounted to a primary leg, and a foot telescopically mounted to said intermediate leg.

10. A shelter system comprising:

a deck system comprising:

a multitude of adjustable leg assemblies, each of said multitude of adjustable leg assemblies includes an upper truss attachment flange and a lower truss attachment flange which extends radially therefrom, said upper truss attachment flange and said lower truss attachment flange including a multiple of truss attachment apertures;

a lower truss attachable to at least two of said multitude of adjustable leg assemblies said lower truss including an upper attachment hook and a lower attachment hook engageable with one of said multiple of truss attachment apertures in said respective upper truss attachment flange and said lower truss attachment flange; and a shelter mounted to said deck system.

11. The system as recited in claim 10, wherein each of said multitude of adjustable leg assemblies include an intermediate leg telescopically mounted to a primary leg, and a foot telescopically mounted to said intermediate leg.

12. The system as recited in claim 10, wherein said deck system includes a multitude of deck surface panels supported upon said multitude of adjustable leg assemblies.

13. The system as recited in claim 12, wherein said shelter includes a support column mounted to one of said multitude of adjustable leg assemblies through at least one of said multitude of deck surface panels.

14. The system as recited in claim 12, wherein said shelter includes a support column mounted to one of said multitude of adjustable leg assemblies through at least two of said multitude of deck surface panels.

15. The system as recited in claim 12, wherein said shelter includes a wall system engaged between two of said multitude of deck surface panels.

16. The system as recited in claim 10, wherein said shelter is mounted at least partially between two deck surface panels of said deck system.

17. The system as recited in claim 10, wherein said shelter includes a multitude of structures.

18. The system as recited in claim 10, wherein said shelter includes a multitude of connected structures.

* * * * *